US012286971B2

(12) United States Patent
Lee et al.

(10) Patent No.: US 12,286,971 B2
(45) Date of Patent: Apr. 29, 2025

(54) SCROLL COMPRESSOR

(71) Applicant: LG ELECTRONICS INC., Seoul (KR)

(72) Inventors: Minho Lee, Seoul (KR); Sungyong Ahn, Seoul (KR); Junghoon Park, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/612,080

(22) Filed: Mar. 21, 2024

(65) Prior Publication Data

US 2024/0328418 A1 Oct. 3, 2024

(30) Foreign Application Priority Data

Apr. 3, 2023 (KR) ..... 10-2023-0043614

(51) Int. Cl.
*F04C 18/02* (2006.01)
*F04C 29/02* (2006.01)

(52) U.S. Cl.
CPC ..... *F04C 18/0215* (2013.01); *F04C 18/0253* (2013.01); *F04C 18/0261* (2013.01);
(Continued)

(58) Field of Classification Search
CPC .. F04C 18/0215; F04C 29/02; F04C 2240/30; F04C 2240/50; F04C 23/008;
(Continued)

(56) References Cited

U.S. PATENT DOCUMENTS 8,215,933 B2 * 7/2012 Kim ..... F04C 18/0253 418/55.6
8,992,191 B2 * 3/2015 Ahn ..... F04C 29/025 418/94

(Continued)

FOREIGN PATENT DOCUMENTS

EP 2163766 A2 * 3/2010 ..... F04C 18/0215
EP 3 575 602 12/2019

(Continued)

OTHER PUBLICATIONS

KR-20180091577-A, English language machine translation (Year: 2018).*

(Continued)

*Primary Examiner* — Wesley G Harris
(74) *Attorney, Agent, or Firm* — KED & ASSOCIATES

(57) ABSTRACT

A scroll compressor is provided that may include a casing, a main frame, a rotational shaft, an orbiting scroll, a fixed scroll, and an oil supply guide. A second oil supply guide of the oil supply guide may be disposed in at least one of the orbiting scroll or the fixed scroll and extend along a thrust bearing surface between the orbiting scroll and the fixed scroll to provide communication between a first oil supply guide and a compression chamber having a lower pressure than an oil storage space. This may produce a great pressure difference between ends of an oil supply passage including the first oil supply guide and the second oil supply guide, and allow smooth oil supply using differential pressure to the thrust bearing surface between the fixed scroll and the orbiting scroll.

8 Claims, 16 Drawing Sheets

(52) U.S. Cl.
CPC ..... *F04C 29/02* (2013.01); *F04C 29/023* (2013.01); *F04C 29/028* (2013.01); *F04C 2240/30* (2013.01); *F04C 2240/50* (2013.01)

(58) Field of Classification Search
CPC ..... F04C 29/023; F04C 29/028; F04C 2240/603; F04C 18/0261; F04C 28/26; F04C 18/0292; F04C 18/0253
See application file for complete search history.

(56) References Cited

U.S. PATENT DOCUMENTS

| | | | | |
|---|---|---|---|---|
| 2014/0010694 | A1 | 1/2014 | Tsuka et al. | |
| 2018/0231002 | A1* | 8/2018 | Lee | F01C 21/02 |
| 2018/0372103 | A1* | 12/2018 | Choi | F04C 27/005 |
| 2021/0381508 | A1 | 12/2021 | Iljima et al. | |

FOREIGN PATENT DOCUMENTS

| | | | | |
|---|---|---|---|---|
| JP | 2004-060532 | | 2/2004 | |
| JP | 2014-129793 | | 7/2014 | |
| KR | 2001-0089600 | | 10/2001 | |
| KR | 10-2011-0064663 | | 6/2011 | |
| KR | 10-2018-0091577 | | 8/2018 | |
| KR | 20180091577 | A * | 8/2018 | F04C 18/02 |
| WO | WO-2012127719 | A1 * | 9/2012 | F04C 18/0215 |
| WO | WO-2020120659 | A1 * | 6/2020 | F04C 18/0261 |

OTHER PUBLICATIONS

WO-2020120659-A1, English language machine translation (Year: 2020).*
EP-2163766-A2, English language machine translation (Year: 2010).*
WO-2012127719-A1, English language machine translation (Year: 2012).*
Korean Office Action issued in Application No. 10-2023-0043614 dated Aug. 8, 2024.
European Search Report issued in Application No. 24167290.6 dated Sep. 2, 2024.

* cited by examiner

SCROLL COMPRESSOR

CROSS-REFERENCE TO RELATED APPLICATION(S)

Pursuant to 35 U.S.C. § 119 (a), this application claims the benefit of the earlier filing date and the right of priority to Korean Patent Application No. 10-2023-0043614, filed in Korea on Apr. 3, 2023, the contents of which are incorporated by reference herein in their entirety.

BACKGROUND

1. Field

A scroll compressor is disclosed herein.

2. Background

A compressor applied to a refrigeration cycle, such as a refrigerator or an air conditioner, serves to compress refrigerant gas and transmit the compressed refrigerant gas to a condenser. A rotary compressor or a scroll compressor is mainly applied to an air conditioner. Recently, the scroll compressor has been applied not only to the air conditioner but also to a compressor for hot water supply that requires a higher compression ratio than the air conditioner.

A scroll compressor may be classified as a hermetic compressor when a drive (or motor) and a compression unit are disposed in one casing, while being classified as an open type compressor when those components are independently disposed. Also, the scroll compressor may be classified as a top-compression type when the compression unit is located above the drive while being classified as a bottom compression type when the compression unit is located below the drive. Further, the scroll compressor may be classified as a low-pressure type when a space accommodating the drive forms a suction pressure, while being classified as a high-pressure type when it forms a discharge pressure.

Scroll compressors include a fixed scroll having a fixed wrap, and an orbiting scroll having an orbiting wrap engaged with the fixed wrap. Scroll compressors may be categorized into an orbiting back pressure type and a fixed back pressure type depending on how a back pressure is formed. The orbiting back pressure type forms a back pressure chamber on a rear surface of the orbiting scroll, while the fixed back pressure type forms a back pressure chamber on a rear surface of the fixed scroll. In the fixed back pressure type, the fixed scroll is normally referred to as a non-orbiting scroll.

In the scroll compressor as described above, a thrust bearing surface is formed between the orbiting scroll and the fixed scroll, so that the orbiting scroll makes an orbital movement while in sliding contact with the fixed scroll. In this case, in the orbiting back pressure method and/or the fixed back pressure method, the orbiting scroll is in close contact with the fixed scroll, so friction loss may occur on the thrust bearing surface between the orbiting scroll and the fixed scroll.

Accordingly, in the related art, an oil supply passage along which oil is supplied to the thrust bearing surface between the fixed scroll and the orbiting scroll is formed to reduce the friction loss between the orbiting scroll and the fixed scroll. In the related art scroll compressor, an oil supply groove is formed in an annular shape in the thrust surface of the fixed scroll.

However, in the related art scroll compressor, as the oil supply groove is formed in the annular shape in the thrust bearing surface between the orbiting scroll and the fixed scroll, the number of turns of the orbiting wrap is limited, which causes a problem in that a suction volume decreases or an outer diameter of the compressor increases. Considering this, if a portion of the oil supply groove is formed to be exposed to the outside of the thrust bearing surface, the oil supply passage may be partially disconnected and an oil supply amount may be reduced.

Further, in the related art scroll compressor, the oil supply groove is formed in the annular shape in the thrust bearing surface between the orbiting scroll and the fixed scroll, so a great pressure difference does not occur between the oil supply groove and an oil storage space. This causes a problem that oil in the oil storage space is not smoothly supplied to the oil supply groove. This may aggravate friction loss due to oil shortage even in low-pressure ratio operation conditions as well as high-pressure ratio operation conditions.

BRIEF DESCRIPTION OF THE DRAWINGS

Embodiments will be described in detail with reference to the following drawings in which like reference numerals refer to like elements, and wherein:

FIG. 5A shows a communication state with a first compression chamber and FIG. 5B shows a communication state with a second compression chamber;

DETAILED DESCRIPTION

Description will now be given of a scroll compressor according to exemplary embodiments disclosed herein, with reference to the accompanying drawings.

Typically, a scroll compressor may be classified as a hermetic type or an open type depending on whether a drive motor and a compression unit are all installed in an inner space of a casing. This embodiment will be described mainly based on the hermetic scroll compressor. However, embodiments may also be equally applied to the open type scroll compressor.

Scroll compressors may also be classified into a fixed scroll compressor and a movable scroll compressor. The fixed type is usually applied for air conditioning in a building, and the movable type is applied for air conditioning in a vehicle. This embodiment will be described mainly based on the fixed type scroll compressor. However, embodiments may also be equally applied to the movable type scroll compressor.

In addition, scroll compressors may be classified into a low-pressure type and a high-pressure type depending on a pressure of refrigerant filled in an inner space of a casing. In the low-pressure type, the inner space of the casing is filled with refrigerant of a suction pressure. In contrary, in the high-pressure type, the inner space of the casing is filled with refrigerant of a discharge pressure. This embodiment will be described mainly based on the high-pressure type scroll compressor. However, embodiments may also be equally applied to the low-pressure type scroll compressor.

In addition, scroll compressors may be classified into a top-compression type and a bottom-compression type depending on an installation position of a compression unit. The top-compression type includes a compression unit disposed above a drive motor while the bottom-compression type includes a compression unit disposed below a drive motor. This embodiment will be described mainly based on the top-compression type scroll compressor. However, embodiments may also be equally applied to the bottom-compression type scroll compressor.

Scroll compressors may also be classified into a one-sided rotation scroll compressor and an inter-rotation scroll compressor depending on whether scrolls rotate. The one-sided rotation scroll compressor is configured such that one scroll is fixed or restricted from rotating and the other scroll pivots, while the inter-rotation scroll compressor is configured such that both scrolls rotate. This embodiment will be described mainly based on the one-sided rotation scroll compressor. However, embodiments may also be equally applied to the inter-rotation scroll compressor.

Figure 1:
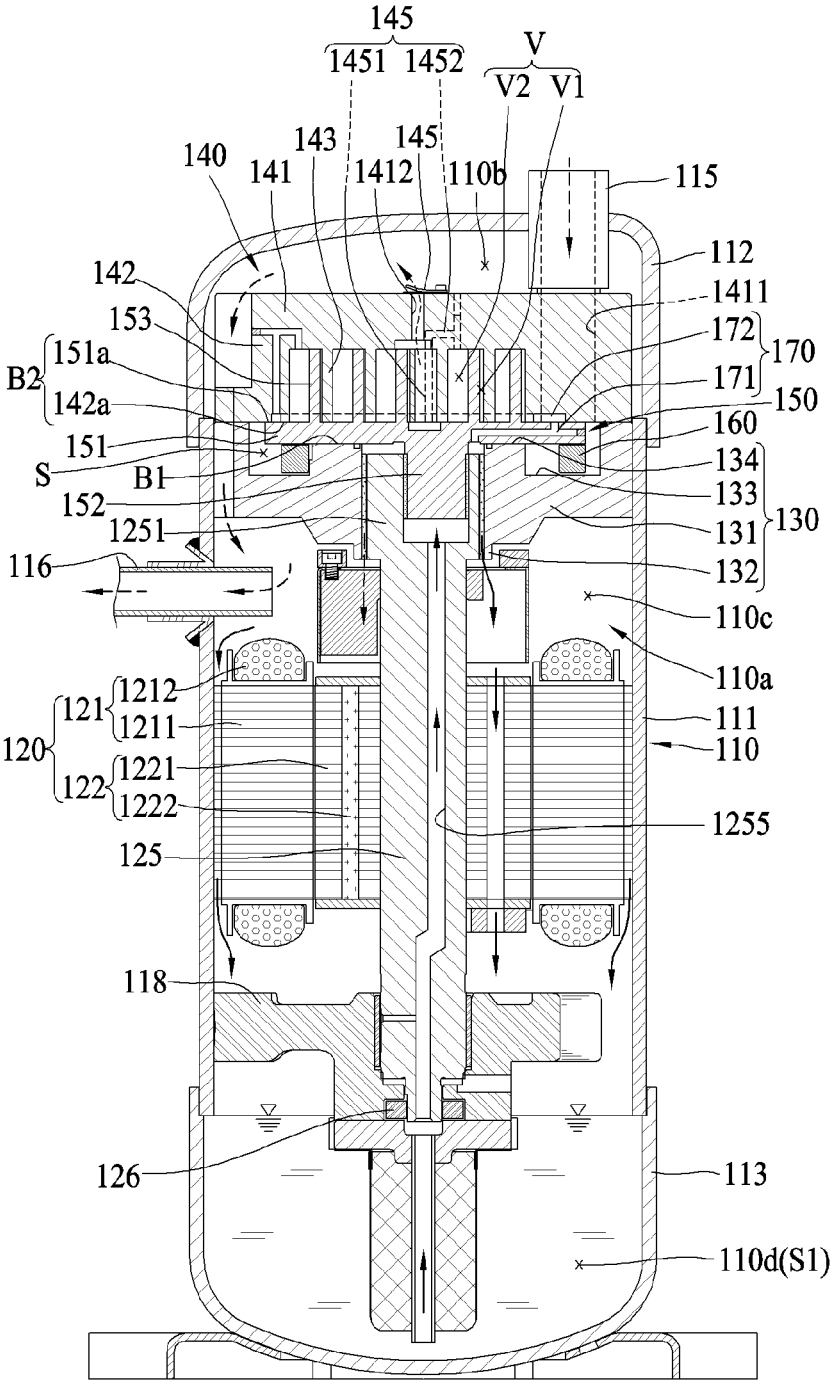
FIG. 1 is a cross-sectional view of a scroll compressor in accordance with an embodiment.

FIG. 1 is a cross-sectional view of a scroll compressor in accordance with an embodiment. Referring to FIG. 1, a scroll compressor according to an embodiment may include a drive motor 120 disposed in a lower half portion of a casing 110, and a main frame 130 disposed above the drive motor 120. A compression unit may be installed on an upper side of the main frame 130. The compression unit may include a fixed scroll 140 and an orbiting scroll 150, and in some cases, the main frame 130 may also be described as being included in the compression unit.

The casing 110 may include a cylindrical shell 111, an upper cap 112, and a lower cap 113. Accordingly, an inner space 110*a* of the casing 110 may be divided into an upper space 110*b* defined inside of the upper cap 112, an intermediate space 110*c* defined inside of the cylindrical shell 111, and a lower space 110*d* defined inside of the lower cap 113, based on an order that refrigerant flows. Hereinafter, the upper space 110*b* may be defined as a discharge space, the intermediate space 110*c* may be defined as an oil separation space, and the lower space 110*d* may be defined as an oil storage space, respectively.

The cylindrical shell 111 may have a cylindrical shape with upper and lower ends open, and the drive motor 120 and the main frame 130 may be, for example, press-fitted to an inner circumferential surface of the cylindrical shell 111 in the lower half portion and the upper half portion, respectively.

A refrigerant discharge pipe 116 may be inserted through the intermediate space 110*c* of the cylindrical shell 111, for example, coupled through a gap between the drive motor 120 and the main frame 130. The refrigerant discharge pipe 116 may be directly inserted into the cylindrical shell 111 to be, for example, welded thereon. Alternatively, an intermediate connecting pipe (that is, collar pipe) 117 typically made of a same material as the cylindrical shell 111 may be inserted into the cylindrical shell 111 to be, for example, welded thereon, and then the refrigerant discharge pipe 116 made of, for example, copper may be inserted into the intermediate connection pipe 117 to be, for example, welded thereon.

The upper cap 112 may be coupled to cover the upper opening of the cylindrical shell 111. A refrigerant suction pipe 115 may be coupled through the upper cap 112. The refrigerant suction pipe 115 may be inserted through the upper space 110*b* of the casing 110 to be directly connected to a suction pressure chamber (no reference numeral given) of the compression unit described hereinafter. Accordingly, refrigerant may be supplied into a suction chamber (or suction pressure chamber) through the refrigerant suction pipe 115.

The lower cap 113 may be coupled to cover the lower opening of the cylindrical shell 111. The lower space 110*d* of the lower cap 113 defines an oil storage space S1 in which a preset or predetermined amount of oil is stored. The lower space 110*d* defining the oil storage space S1 communicates with the upper space 110*b* and the intermediate space 110*c* of the casing 110 through an oil return passage (no reference numeral). Accordingly, oil separated from refrigerant in the upper space 110*b* and the intermediate space 110*c* and oil returned after being supplied to the compression unit may all be returned into the lower space 110*d* defining the oil storage space S1 through an oil return passage to be stored therein.

Referring to FIG. 1, the drive motor 120 according to this embodiment is disposed in the lower half portion of the intermediate space 110*c* defining the high-pressure portion at the inner space 110*a* of the casing 110, and may include a stator 121 and a rotor 122. The stator 121 may be, for example, shrink-fitted to an inner wall surface of the casing 111, and the rotor 122 may be rotatably provided inside of the stator 121.

The stator 121 may include a stator core 1211 and a stator coil 1212. The stator core 1211 may be formed in a cylindrical shape and, for example, shrink-fitted onto the inner circumferential surface of the cylindrical shell 111. The stator coil 1212 may be wound around the stator core 1211 and electrically connected to an external power source through a terminal (not illustrated) that is coupled through the casing 110.

The rotor 122 may include a rotor core 1221 and permanent magnets 1222. The rotor core 1221 may be formed in a cylindrical shape, and be rotatably inserted into the stator core 1211 with a preset or predetermined gap therebetween. The permanent magnets 1222 may be embedded in the rotor core 1222 at preset or predetermined distances along a circumferential direction.

A rotational shaft 125 may be, for example, press-fitted to the rotor 122. An upper end portion of the rotational shaft 125 may be rotatably inserted into the main frame 130 described hereinafter so as to be supported in a radial direction, and a lower end portion of the rotational shaft 125 may be rotatably inserted into a sub frame 118 to be supported in the radial and axial directions.

An eccentric portion 1251 may be disposed on an upper end of the rotational shaft 125, and be coupled to a rotational shaft coupling portion 153 of an orbiting scroll 150, which will be described hereinafter. The eccentric portion 1251 may be inserted into the rotational shaft coupling portion 153 or the rotational shaft coupling portion 153 may be inserted into the eccentric portion 1251. In this embodiment, an example in which the rotational shaft coupling portion 153 is inserted into the eccentric portion 1251 of the rotational shaft 125 is shown.

In addition, an oil supply hole 1255 may be formed inside of the rotational shaft 125 to penetrate through between both ends of the rotational shaft 125. The oil supply hole 1255 may extend from a lower end of the rotational shaft 125 to a bottom surface of an eccentric portion 1251. Accordingly, oil stored in the lower space 110*d* defining the oil storage space may be supplied into the eccentric portion 1251 through the oil supply hole 1255.

An oil pickup 126 may be installed at the lower end of the rotational shaft 125, more specifically, at a lower end of the oil supply hole 1255. The oil pickup 126 may be submerged in the oil stored in the oil storage space 110*d*. Accordingly, the oil stored in the oil storage space 110*d* may be pumped by the oil pickup 126 to be suctioned upward through the oil supply hole 1255.

Referring to FIG. 1, the main frame 130 according to this embodiment is disposed on an upper side of the drive motor 120, and, for example, shrink-fitted to or welded on an inner wall surface of the cylindrical shell 111. The main frame 130 may include a main flange portion 131, a shaft support protrusion 132, and a back pressure space portion 133.

The main flange portion 131 is a portion that supports the orbiting scroll 150, which will be described hereinafter, in the axial direction. The main flange portion 131 may be formed in an annular shape and accommodated in the intermediate space 110*c* of the cylindrical shell 111. For example, an upper surface of the main flange portion 131 may be a scroll support surface 134 that defines a thrust bearing surface (hereinafter, referred to as a "first thrust bearing surface"). Accordingly, a lower surface (or rear surface) of an orbiting end plate 151, which will be described hereinafter, may be slidably placed on the scroll support surface 134 to be supported in the axial direction.

The shaft support protrusion 132 may extend from a center of the main flange portion 131 toward the drive motor 120 and a shaft support hole 1321 may be formed inside of the shaft support protrusion 132. The shaft support hole 1321 may be formed through both axial side surfaces of the main flange portion 131. Accordingly, the main flange portion 131 may have an annular shape.

The back pressure space portion 133 is a portion that defines a back pressure chamber S2 together with a fixed thrust surface 142*a*, which will be described hereinafter, and may be formed in an annular shape by being recessed into an edge of the scroll support surface 134 to a preset or predetermined depth. The back pressure space portion 133 communicates with the intermediate pressure chamber through a back pressure passage 144, which will be described hereinafter, to form a back pressure that is an intermediate pressure between a suction pressure and a discharge pressure. Accordingly, the orbiting scroll 150 is pushed up toward the fixed scroll 140 by the pressure of the back pressure space portion 133, and an orbiting thrust surface 151*a*, which will be described hereinafter, is thereby brought into close contact with the fixed thrust surface 142*a*, forming a thrust bearing surface (hereinafter, referred to as a "second thrust bearing surface") B2. The second thrust bearing surface B2 will be described hereinafter in relation to the fixed scroll 140 and/or orbiting scroll 150.

Referring to FIG. 1, the fixed scroll 140 according to this embodiment may include a fixed end plate 141, a fixed side wall portion 152, and a fixed wrap 143. The fixed end plate 141 may be formed in a disk shape. An outer circumferential surface of the fixed end plate 141 may be in close contact with an inner circumferential surface of the upper cap 112 defining the upper space 110*b* or may be spaced apart from the inner circumferential surface of the upper cap 112. The fixed end plate 141 may have a same (uniform) thickness. Accordingly, a root end of the fixed wrap 143 described hereinafter may be formed at a same height throughout the fixing wrap 143.

A suction port 1411 may be formed through an edge (rim) of the fixed end plate 141 in the axial direction to communicate with a suction pressure chamber (no reference numeral). The refrigerant suction pipe 115 may be inserted into the suction port 1411 through the upper cap 112 of the casing 110. Accordingly, the refrigerant suction pipe 115 may directly communicate with the suction port 1411 of the fixed scroll 140 through the upper space 110*b* of the casing 110.

A discharge port 1412 and a bypass hole (not illustrated) may be formed through a center of the fixed end plate 141. A discharge valve 145 that opens and closes the discharge port 1412 and a bypass valve (not illustrated) that opens and closes the bypass hole may be disposed on an upper surface of the fixed end plate 141. Accordingly, refrigerant compressed in a first compression chamber V1 and a second compression chamber V2 may be discharged from an upper side of the fixed scroll 140 into the upper space 110*b* defined in the upper cap 112. Hereinafter, description will be given under the assumption that a compression chamber formed between an outer surface of the orbiting wrap 152 and an inner surface of the fixed wrap 143 facing the same is defined as a first compression chamber V1 and a compression chamber formed between an inner surface of the orbiting wrap 152 and an outer surface of the fixed wrap 143 facing the same is defined as a second compression chamber V2.

A portion of the back pressure passage 144 is formed in the fixed end plate 141. As described above, the back pressure passage 144 is a passage through which refrigerant of an intermediate pressure is supplied to the back pressure space portion 133 forming the back pressure chamber S2. Thus, one or a first end of the back pressure passage 144 communicates with a compression chamber V forming intermediate pressure, and another or a second end of the back pressure passage 144 communicates with the back pressure space portion 133. Accordingly, the back pressure passage 144 may be formed continuously through the fixed end plate 141 and the fixed side wall portion 142.

The fixed side wall portion 142 may extend in an annular shape from the edge of the fixed end plate 141 toward the main frame 130. Accordingly, a lower surface of the fixed side wall portion 142 may be coupled by, for example, bolts in close contact with an upper surface of the main frame 130, that is, an upper surface of the main flange portion 131.

The lower surface of the fixed side wall portion 142, that is, a surface facing the orbiting thrust surface 151*a*, which will be described hereinafter, is the fixed thrust surface 142*a* which is in sliding contact with the orbiting thrust surface 151*a* to define the second thrust bearing surface B2. Accordingly, the orbiting scroll 150 may be supported in both axial directions by the scroll support surface 134 of the main frame 130 and the lower surface of the fixed side wall portion 142.

The second end of the back pressure passage 144 is formed on one side of the thrust bearing surface of the fixed side wall portion 142, that is, the fixed thrust surface 142*a*.

For example, a back pressure connection hole 1441 may be formed in the fixed scroll 140 to continuously penetrate the fixed end plate 141 and the fixed side wall portion 142, and a back pressure connection groove 1442 may be formed in the fixed thrust surface 142*a*. One or a first end of the back pressure connection hole 1441 may communicate with a compression chamber V forming intermediate pressure and another or a second end of the back pressure connection hole 1441 may communicate with the back pressure connection groove 1442, to form the back pressure passage 144.

The back pressure connection groove 1442 may extend lengthwise in the radial direction up to an outside of the orbiting radius of the orbiting scroll 150, and the back pressure connection hole 1441 may communicate through one end of the back pressure connection groove 1442. Accordingly, even if the orbiting thrust surface 151*a* makes an orbital movement in a sliding contact state with the fixed thrust surface 142*a*, the back pressure connection groove 1442 may always be in communication with the back pressure space portion 133.

A second oil supply guide 172, which communicates between a first oil supply guide 171 described hereinafter, and the compression chamber V1, V2 are formed in another or a second side of the fixed thrust surface 142*a*. In other words, the second oil supply guide 172 may be formed in the fixed thrust surface 142*a* defining the second thrust bearing surface. One or a first end of the second oil supply guide 172 may communicate with an outlet of the first oil supply guide 171, and another or a second end may communicate with a compression chamber (an intermediate pressure chamber or a suction pressure chamber) V1, V2. This may cause a great pressure difference between ends of an oil supply passage (hereinafter, referred to as a "second oil supply passage") that is defined by the oil supply hole 1255 of the rotational shaft 125, the first oil supply guide 171 of the orbiting scroll 150, and the second oil supply guide 172 of the fixed scroll 140. With this structure, oil stored in the oil storage space S1 of the casing 110 may be smoothly guided to the second oil supply guide 172 through the oil supply hole 1255 of the rotational shaft 125 and the first oil supply guide 171 of the orbiting scroll 150, thereby effectively lubricating the second thrust bearing surface B2. The second oil supply guide 172 will be described again together with the first oil supply guide 171 hereinafter.

The fixed wrap 143 extends from a lower surface of the fixed end plate 141 toward the orbiting scroll 150. The fixed wrap 143 may be formed in various shapes, such as an involute shape. For example, the fixed wrap 143 may be a logarithmic spiral wrap or may be configured by a plurality of arcuate curves.

The fixed wrap 143 may have a same wrap height or different heights in a wrap formation direction. In this embodiment, an example in which the fixed wrap 143 has the same wrap height is illustrated.

Referring to FIG. 1, the orbiting scroll 150 according to this embodiment may include the orbiting end plate 151, the orbiting wrap 152, and the rotational shaft coupling portion 153. The orbiting end plate 151 may be formed in a disk shape and be supported in the axial direction by the main frame 130 so as to perform an orbiting motion between the main frame 130 and the fixed scroll 140. In other words, a lower surface of the orbiting end plate 151 forms a first thrust bearing surface B1 together with the scroll support surface 134 of the main frame 130, and an upper surface of the orbiting end plate 151 forms the orbiting thrust surface 151*a*, which defines a second thrust bearing surface B2, together with the fixed thrust surface 142*a* of the fixed side wall portion 142. In the following description, the upper surface of the orbiting end plate 151 facing the fixed thrust surface 142*a* is defined as the orbiting thrust surface 151*a*.

The first oil supply guide 171 may be formed inside of the orbiting end plate 151. One or a first end of the first oil supply guide 171 may communicate with the oil supply hole 1255 of the rotational shaft 125 through the lower surface of the orbiting end plate 151, and another or a second end of the first oil supply guide 171 may communicate with the second oil supply guide 172 through the upper surface of the orbiting end plate 151, namely, the orbiting thrust surface 151*a*. A pressure-reducing pin (no reference numeral) may be inserted into the first oil supply guide 171 to lower the pressure of oil passing through the first oil supply guide 171 to an appropriate pressure. This may suppress or prevent an increase in specific volume of refrigerant due to oil, which is introduced into the compression chamber V1, V2, even if another or second end of a second oil supply passage 170 including the first oil supply guide 171 communicates with the compression chamber V1, V2.

The orbiting wrap 152 may extend toward the fixed scroll 140 from the upper surface (compression surface) of the orbiting end plate 151. The orbiting wrap 152 may then be engaged with the fixed wrap 143 to define the pair of compression chambers V1 and V2.

The orbiting wrap 152 may be formed in various shapes, such as an involute shape, to correspond to the fixed wrap 143. For example, the orbiting wrap 152 may be a logarithmic spiral wrap or may be configured by a plurality of arcuate curves.

The orbiting wrap 152 may have a same wrap height or different heights in the wrap formation direction. In this embodiment, an example in which the orbiting wrap 142 has the same wrap height along the wrap formation direction is illustrated.

The rotational shaft coupling portion 153 may extend from a geometric center of the orbiting scroll 150 toward the eccentric portion 1251 of the rotational shaft 125. The rotational shaft coupling portion 153 may be rotatably inserted into the eccentric portion 1251 of the rotational shaft 125. Accordingly, the orbiting scroll 150 may perform the orbiting motion by the eccentric portion 1251 of the rotational shaft 125 and the rotational shaft coupling portion 153.

In the drawings, unexplained reference numeral 160 denotes an Oldham ring.

The scroll compressor according to this embodiment may operate as follows.

That is, when power is applied to the drive motor 120 and a rotational force is generated, the orbiting scroll 160 eccentrically coupled to the rotational shaft 125 performs an orbiting motion relative to the fixed scroll 140 due to the Oldham ring 160. At this time, a first compression chamber V1 and a second compression chamber V2 that continuously move are formed between the fixed scroll 140 and the orbiting scroll 150.

The first compression chamber V1 and the second compression chamber V2 are gradually reduced in volume while moving from the suction port 1411 (or suction pressure chamber) to the discharge port 1412 (or discharge pressure chamber) during the orbiting motion of the orbiting scroll 150. Refrigerant is then introduced into the first compression chamber V1 and the second compression chamber V2 through the suction port 1411 of the fixed scroll 140 via the refrigerant suction pipe 115. The refrigerant is compressed while moving toward the final compression chamber by the orbiting scroll 150. The refrigerant is discharged from the final compression chamber into the inner space 110*b* of the casing 110 through the discharge port 1412 of the fixed scroll 140, and then moves to the intermediate space 110*c* and/or the lower space 110*d* of the casing 110 through an outflow passage (not illustrated) defined in the fixed scroll 140 and the main frame 130.

Oil is separated from the refrigerant while the refrigerant circulates in the inner space 110*a* of the casing 110. The refrigerant from which the oil has been separated is discharged to the outside of the casing 110 through the refrigerant discharge pipe 116, while the oil separated from the refrigerant flows into the oil storage space S1 defining the lower space 110*d* of the casing 110. The oil stored in the oil storage space S1 is supplied to the compression unit through the oil pickup 126 and the oil supply hole 1255 of the rotational shaft 125. These series of processes are repeatedly performed.

At this time, as the first thrust bearing surface B1 and the second thrust bearing surface B2, which support both side surfaces of the orbiting scroll 150 in the axial direction, are formed in the compression unit, the oil supplied to the compression unit is partially supplied to the first thrust bearing surface B1 and partially to the second thrust bearing surface B2. For example, oil suctioned through the oil supply hole 1255 of the rotational shaft 125 partially flows between the scroll support surface 134 of the main frame 130 and the lower surface of the orbiting end plate 151 to lubricate the first thrust bearing surface B1, while partially flowing into the compression chamber V1, V2 through the first oil supply guide 171 disposed in the orbiting scroll 150 and the second oil supply guide 172 disposed in the fixed scroll 140 to lubricate the second thrust bearing surface B2.

In this case, an oil supply passage (hereinafter, referred to as a "first oil supply passage") (no reference numeral) that supplies oil to the first thrust bearing surface B1 and an oil supply passage (hereinafter, referred to as a "second oil supply passage") 170 that supplies oil to the second thrust bearing surface B2 may communicate with the oil storage space S1 and the compression chamber V1, V2, respectively, so that oil may be supplied to the corresponding thrust bearing surfaces B1 and B2 using a pressure difference between both ends of each oil supply passage.

With this structure, oil may be smoothly supplied to the corresponding thrust bearing surfaces B1 and B2 while simplifying the respective oil supply passage (no reference numeral) and 170. The first oil supply passage (no reference numeral) that supplies oil to the first thrust bearing surface B1 employs a well-known technology, and hereinafter, description will be given focusing on the second oil supply passage 170 through which oil is supplied to the second thrust bearing surface B2. Therefore, in the following description, the second thrust bearing surface B2 may also be referred to as the thrust bearing surface, and the second oil supply passage 170 may also be referred to as the oil supply passage.

Figure 2:
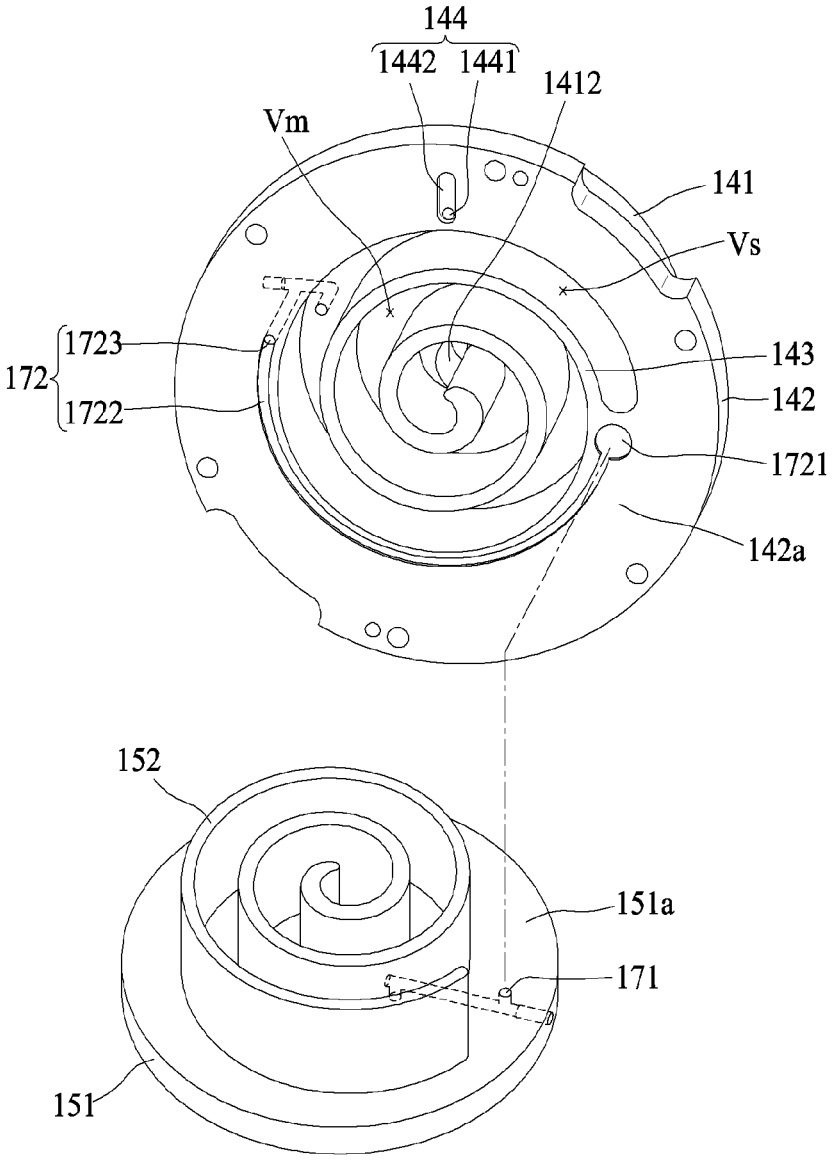
FIG. 2 is an exploded perspective view of a fixed scroll and an orbiting scroll in FIG. 1.
Figure 3:
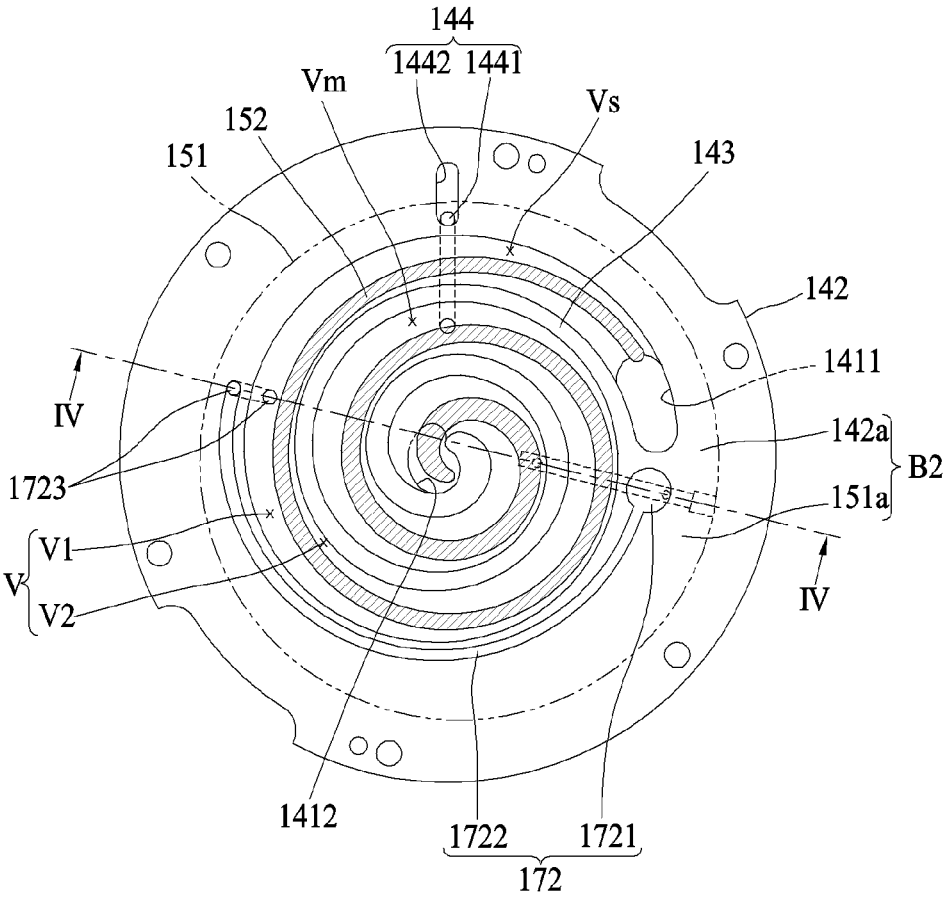
FIG. 3 is an assembled planar view of the fixed scroll and the orbiting scroll in FIG. 2.
Figure 4:
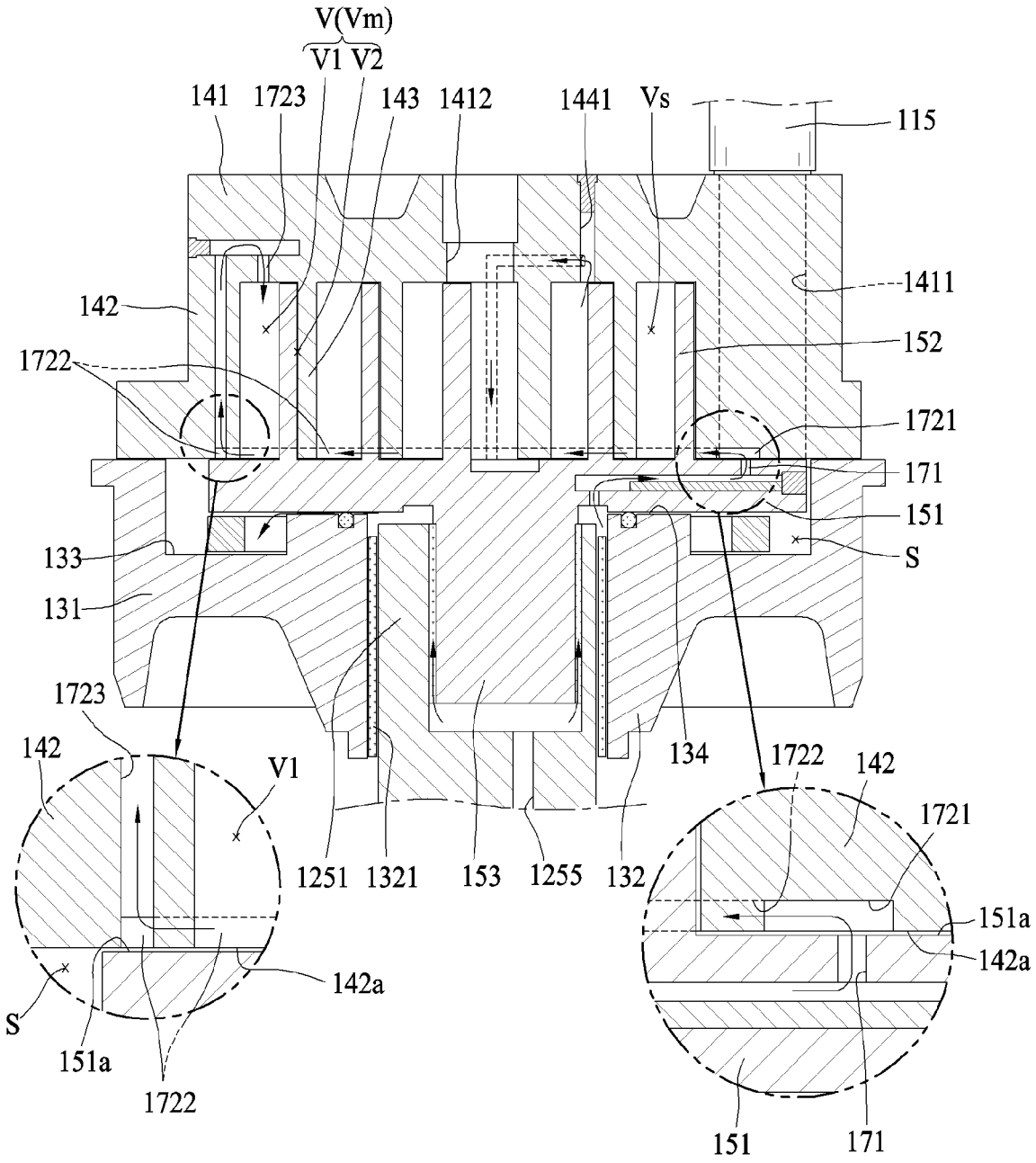
FIG. 4 is a cross-sectional view, taken along line "IV-IV" of FIG. 3.

FIG. 2 is an exploded perspective view of a fixed scroll and an orbiting scroll in FIG. 1. FIG. 3 is an assembled planar view of the fixed scroll and the orbiting scroll in FIG. 2. FIG. 4 is a cross-sectional view, taken along line "IV-IV" of FIG. 3.

Referring to FIGS. 2 to 4, the orbiting scroll 150 according to this embodiment may be provided with the first oil supply guide 171 that communicates with the oil supply hole 1255 of the rotational shaft 125, and the fixed scroll 140 may be provided with the second oil supply guide 172 formed in the fixed thrust surface 142*a*, which defines the portion of the second thrust bearing surface B2, to communicate between the first oil supply guide 171 and the compression chamber. Accordingly, one or a first end of the second oil supply passage 170 through which oil is supplied to the second thrust bearing surface B2 communicates with the oil storage space S1, and another or a second end communicates with the compression chamber V1, V2, such that oil in the oil storage space S1 lubricates the second thrust bearing surface B2 while flowing toward the compression chamber.

The first oil supply guide 171 according to this embodiment penetrates between both axial side surfaces of the orbiting end plate 151. One or a first end of the first oil supply guide 171 may penetrate one side surface (lower surface) of the orbiting end plate 151 to communicate with the oil supply hole 1255 of the rotational shaft 125, and another or a second end may penetrate another side surface (upper surface) of the orbiting end plate 151 to communicate with an oil supply connection groove 1721 of the second oil supply guide 172 described hereinafter.

For example, the first end of the first oil supply guide 171 may penetrate between the shaft support hole 1321 of the main frame 130 and the rotational shaft coupling portion 153 of the orbiting scroll 150, and the second end of the first oil supply guide 171 may penetrate the orbiting thrust surface 151*a*, which defines the second thrust bearing surface B2 together with the fixed thrust surface 142*a*. Accordingly, oil suctioned through the oil supply hole 1255 of the rotational shaft 125 moves from the eccentric portion 1251, which is disposed at an upper end of the rotational shaft 125, into a gap between the shaft support hole 1321 and the rotational shaft coupling portion 153. The oil partially flows into the first oil supply guide 171 between the shaft support hole 1321 and the rotational shaft coupling portion 153 to move toward the second oil supply guide 172.

In this case, as described above, a pressure reducing pin (no reference numeral) may be disposed inside the first oil supply guide 171 to lower the pressure of oil passing through the first oil supply guide 171 from a discharge pressure to an intermediate pressure (or suction pressure). Accordingly, even though both ends of the second oil supply passage 170 are in communication with the oil storage space S1 and the compression chamber V1, V2, oil in the oil storage space S1, a pressure of which is lowered to the intermediate pressure or suction pressure, may be introduced into the compression chamber V1, V2, thereby suppressing or preventing suction loss due to oil introduced through the second oil supply passage 170.

The second oil supply guide 172 allows the first oil supply guide 171 to communicate with a compression chamber V1, V2 having a lower pressure than the oil storage space S1, and may be formed in the fixed thrust surface 142*a* and/or the orbiting thrust surface 151*a* defining the second thrust bearing surface B2. Hereinafter, an example in which the second oil supply guide 172 is formed in the fixed thrust surface 142*a* will be described first, and an example in which the second oil supply guide 172 is formed in the orbiting thrust surface 151*a* will be described hereinafter according to another embodiment.

The second oil supply guide 172 may be located within an orbiting radius range of the orbiting scroll 150, that is, within an orbiting trajectory range of the orbiting thrust surface 151*a*. In other words, the second oil supply guide 172 may be formed to always overlap and cover the orbiting thrust surface 151*a* of the orbiting scroll 150 in the axial direction during the orbiting movement of the orbiting scroll 150. Accordingly, a great pressure difference may be maintained between both ends of the second oil supply passage 170, so that oil in the oil storage space S1 may be quickly and smoothly supplied to the second thrust bearing surface B2.

Referring to FIGS. 2 to 4, the second oil supply guide 172 according to this embodiment may include oil supply connection groove 1721, oil supply extension groove 1722, and oil supply connection hole 1723. The oil supply connection groove 1721, the oil supply extension groove 1722, and the oil supply connection hole 1723 may be connected in series to form one oil supply passage (second oil supply passage) 170. Accordingly, oil which has flowed from the first oil supply guide 171 into the oil supply connection groove 1721 lubricates the second thrust bearing surface B2 while moving toward the relevant compression chamber V1, V2 through the oil extension groove 1723 and the oil supply connection hole 1723.

The oil supply connection groove 1721 is a portion defining an inlet of the second oil supply passage 170, and may communicate with the second end of the first oil supply guide 171 that performs an orbital motion. Accordingly, it is advantageous that the oil supply connection groove 1721 is formed as wide as possible within the range of the orbiting thrust surface 151*a* that performs the orbital motion.

For example, the oil supply connection groove 1721 may be formed in a circular shape around an outermost end of the fixed wrap 143, that is, around a widest part of the fixed thrust surface 142*a*. Accordingly, the oil supply connection groove 1721 may be formed as wide as possible without departing from the orbiting thrust surface 151*a* to always communicate with the first oil supply guide 171 that makes the orbital motion.

The oil supply extension groove 1722 is a portion that determines a substantial lubrication area, and it is advantageous in terms of lubrication for the second thrust bearing surface B2 that the oil supply extension groove 1722 is formed as long as possible. For example, the oil supply extension groove 1722 may be formed in an arcuate shape in the fixed thrust surface 142*a*, with one or a first end communicating with one side surface of the oil supply connection groove 1721 and another or a second end spaced apart from the oil supply connection groove 1712 by a preset or predetermined distance along the circumferential direction. Accordingly, oil flowing into the oil supply connection groove 1721 is guided long to the opposite side of the oil supply connection groove 1721 to lubricate the second thrust bearing surface B2 with an area which is as large as possible.

The oil supply extension groove 1722 may be formed in the fixed thrust surface 142*a* as described above, not to depart from the range of the orbiting thrust surface 151*a* which makes an orbital motion. For example, when it is assumed that a rotational angle (crank angle) at the end of which the first oil supply guide 171 is located farthest from a center of the fixed scroll 140 is referred to as a minimum sealing angle, the second end of the oil supply extension groove 1722 spaced apart from the oil supply connection groove 1721 may overlap the orbiting thrust surface 151*a* even at a minimum sealing angle in the axial direction. Accordingly, the oil supply extension groove 1722 may always be covered by the orbiting thrust surface 151*a* that makes the orbital motion, thereby maintaining a great pressure difference between both ends of the second oil supply passage 170.

The oil supply extension groove 1722 may have a same cross-sectional area between its both ends. For example, a radial width of the oil supply extension groove 1722 may be smaller than a radial width (inner diameter) of the oil supply connection groove 1721, but the cross-sectional area may be the same between the both ends. Accordingly, the oil supply extension groove 1722 may be easily machined and a certain amount of oil may be introduced into the oil supply extension groove 1722 to stably lubricate the second thrust bearing surface B2.

The oil supply connection hole 1723 is a portion through which the second end of the oil supply extension groove 1722 is connected to the compression chamber V1, V2 and it is advantageous in view of securing a pressure difference between both ends of the second oil supply passage 170 that the oil supply connection hole 1723 communicates with a compression chamber V1, V2 having a pressure as low as possible. For example, the oil supply connection hole 1723 may be formed by penetrating between the fixed side wall portion 142 and the fixed end plate 141.

In other words, one or a first end of the oil supply connection hole 1723 may be connected to the second end of the oil supply extension groove 1722, and another or a second end may be connected to the compression chamber V1, V2 at a suction completion angle or a position immediately after the suction completion angle. Accordingly, the oil supply connection hole 1723 may communicate with a compression chamber V1, V2, which has the lowest pressure except for a suction pressure chamber Vs, of the compression chambers V1 and V2, thereby increasing a pressure difference between both ends of the second oil supply passage 170. In addition, as the oil supply connection hole 1723 communicates with the compression chamber V1, V2 at or immediately after the suction completion angle, relatively high-temperature and high-pressure oil may be prevented from flowing into the suction pressure chamber Vs, thereby suppressing or prevent suction loss.

Figure 5A:
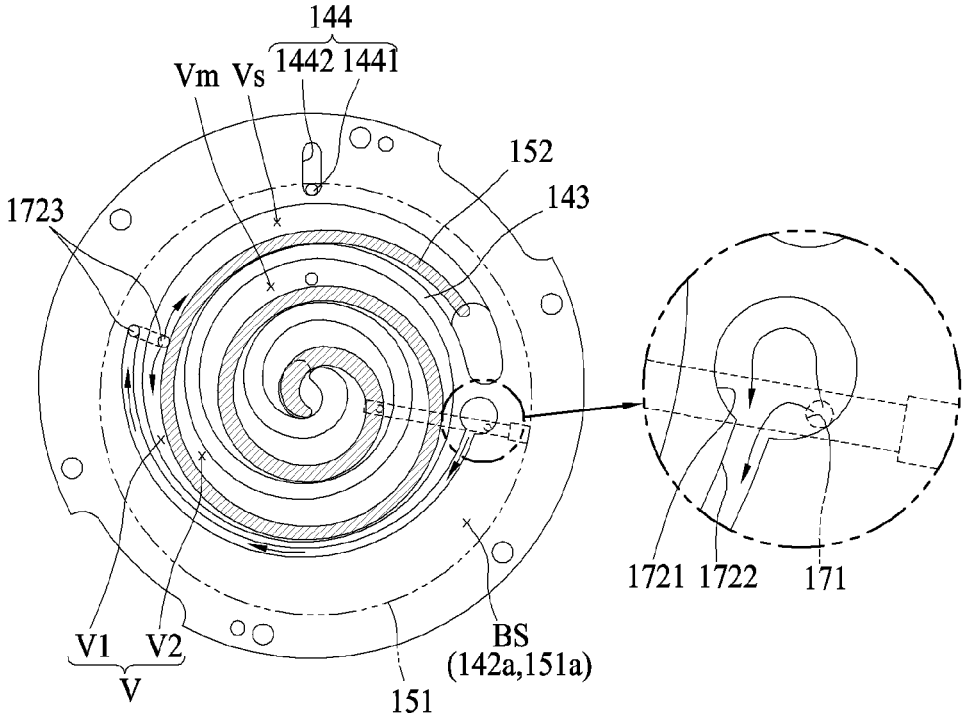
FIGS. 5A-5B are schematic diagrams for explaining a communication position of an oil supply passage according to an orbiting position of the orbiting scroll, where
Figure 5B:
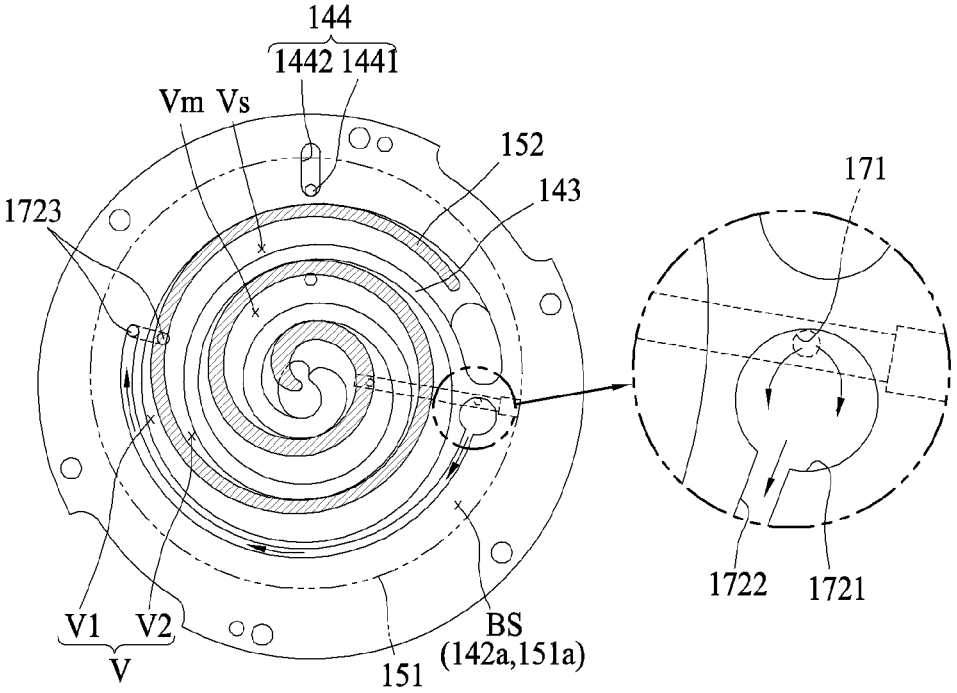

Hereinafter, operation of the oil supply passage according to this embodiment will be described. FIGS. 5A-5B are schematic diagrams for explaining a communication position of an oil supply passage according to an orbiting position of the orbiting scroll, where FIG. 5A shows a communication state with a first compression chamber and FIG. 5B shows a communication state with a second compression chamber.

Referring to FIG. 5A, in a state in which the oil supply connection groove 1721 forming an inlet of the second oil supply guide 172 is connected to the end of the first oil supply guide 171 forming an outlet, the oil supply connection hole 1723 forming the outlet of the second oil supply guide 172 communicates with the first compression chamber. At this time, communication of the first compression chamber V1 with the oil supply connection hole 1723 is made at an adjacent position after a suction completion angle, that is, immediately after suction completion.

As the first compression chamber V1 forms almost the lowest intermediate pressure, the pressure formed in the oil supply connection hole 1723 is much lower than the pressure, namely, the discharge pressure formed in the oil storage space S1. This causes a great pressure difference between the oil storage space S1 forming the inlet of the second oil supply passage 170 and the oil supply connection hole 1723 forming the outlet of the second oil supply passage 170, such that oil in the oil storage space S1 quickly moves toward the oil supply connection hole 1723.

Then, oil is smoothly supplied to the oil supply extension groove 1722, which forms a substantial lubrication passage, to effectively lubricate the thrust surface, namely, the second thrust bearing surface B2 between the fixed scroll 140 and the orbiting scroll 150. This may allow oil to be smoothly supplied to the second thrust bearing surface B2 even during a low-pressure ratio operation relatively having a difficulty in supplying oil as well as being sufficiently supplied to the second thrust bearing surface B2 during a high-pressure ratio operation requiring for a large amount of oil.

Referring to FIG. 5B, in a state in which the oil supply connection groove 1721 forming the inlet of the second oil supply guide 172 is connected to the end of the first oil supply guide 171 forming the outlet, the oil supply connection hole 1723 forming the outlet of the second oil supply guide 172 communicates with the second compression chamber V2. Even at this time, the communication of the second compression chamber V2 with the oil supply connection hole 1723 is made at an adjacent position after a suction completion angle, that is, immediately after suction completion.

Then, in this case as well, as the second compression chamber V2 forms almost the lowest intermediate pressure, pressure formed in the oil supply connection hole 1723 is much lower than the pressure, namely, the discharge pressure formed in the oil storage space S1. This causes a great pressure difference between the oil storage space S1 forming the inlet of the second oil supply passage 170 and the oil supply connection hole 1723 forming the outlet of the second oil supply passage 170, such that oil in the oil storage space S1 quickly moves toward the oil supply connection hole 1723.

Then, oil is smoothly supplied to the oil supply extension groove 1722, which forms a substantial lubrication passage, to effectively lubricate the thrust surface, namely, the second thrust bearing surface B2 between the fixed scroll 140 and the orbiting scroll 150. This may also allow oil to be smoothly supplied to the second thrust bearing surface B2 even during a low-pressure ratio operation relatively having a difficulty in supplying oil as well as being sufficiently supplied to the second thrust bearing surface B2 during a high-pressure ratio operation requiring for a large amount of oil.

Although not illustrated in the drawings, the oil supply connection hole 1723 may communicate with the first compression chamber V1 or the second compression chamber V2 at any orbiting position, except a position hidden by the orbiting wrap 152. Accordingly, a great pressure difference may be maintained between both ends of the second oil supply passage 170, and thus, oil may be smoothly supplied to the oil supply extension groove 1722, which forms the substantial lubrication passage.

In this way, a great pressure difference may be generated between both ends of the oil supply passage that guides oil to the thrust bearing surface between the fixed scroll and the orbiting scroll, enabling a smooth oil supply using differential pressure to the thrust bearing surface between the fixed scroll and the orbiting scroll.

Further, as the end of the oil supply extension groove forming the substantial oil supply passage communicates with the compression chamber, oil may be smoothly supplied to the thrust bearing surface between the fixed scroll and the orbiting scroll while ensuring a suction volume of the compression chamber as large as possible.

Furthermore, the end of the oil supply extension groove, which forms the substantial oil supply passage, may communicate with a compression chamber immediately after suction is completed or a compression chamber before suction is completed, which may allow the oil supply guide portion to be as long as possible in the thrust bearing surface between the fixed scroll and the orbiting scroll while securing the suction volume of the compression chamber as large as possible.

Hereinafter, description will be given of an oil supply passage according to another embodiment. That is, in the previous embodiment, the oil supply extension groove is formed to have the same cross-sectional area between both ends thereof, but in some cases, the oil supply extension groove may be formed to have different cross-sectional areas or partially different cross-sectional areas between the both ends.

Figure 6:
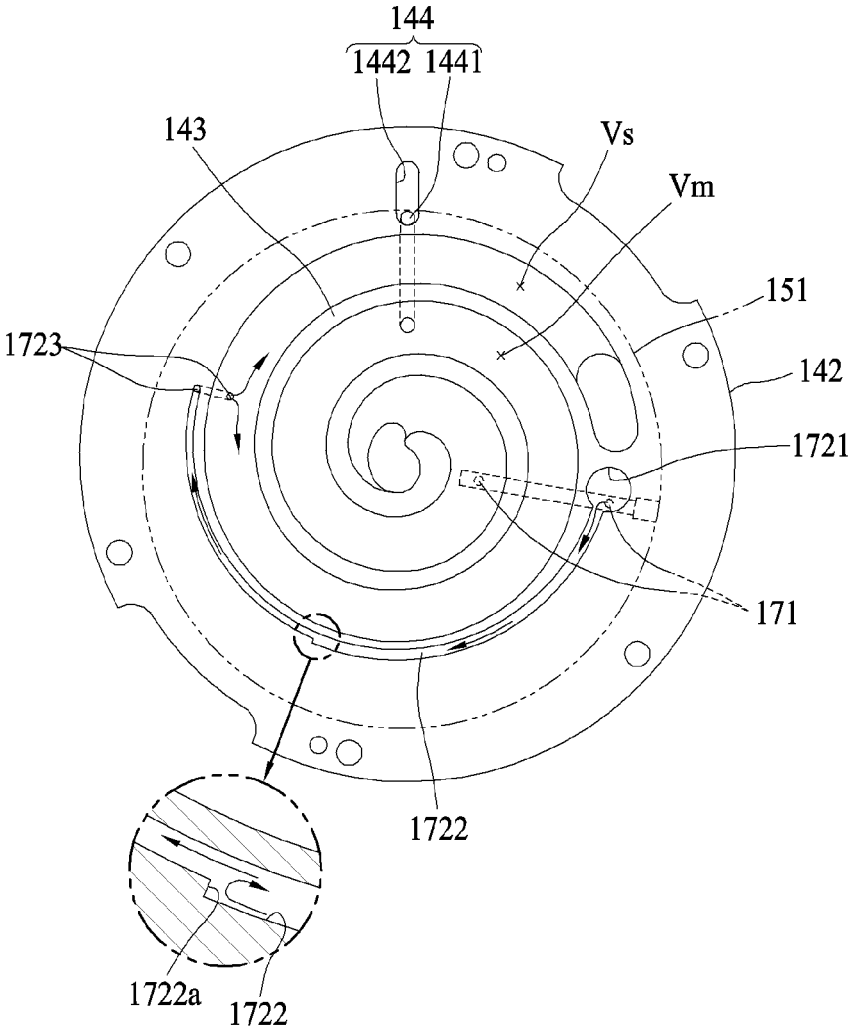
FIGS. 6 through 8 are planar views of a second oil supply guide according to different embodiments.
Figure 7:
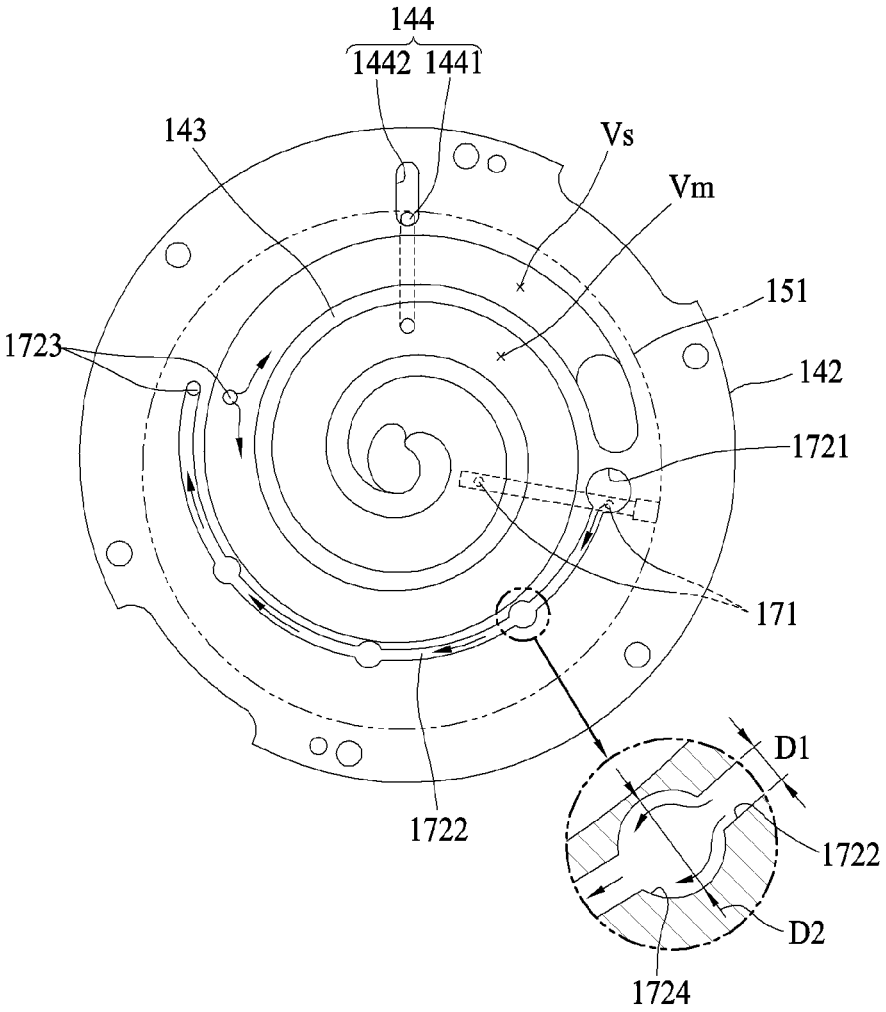
Figure 8:
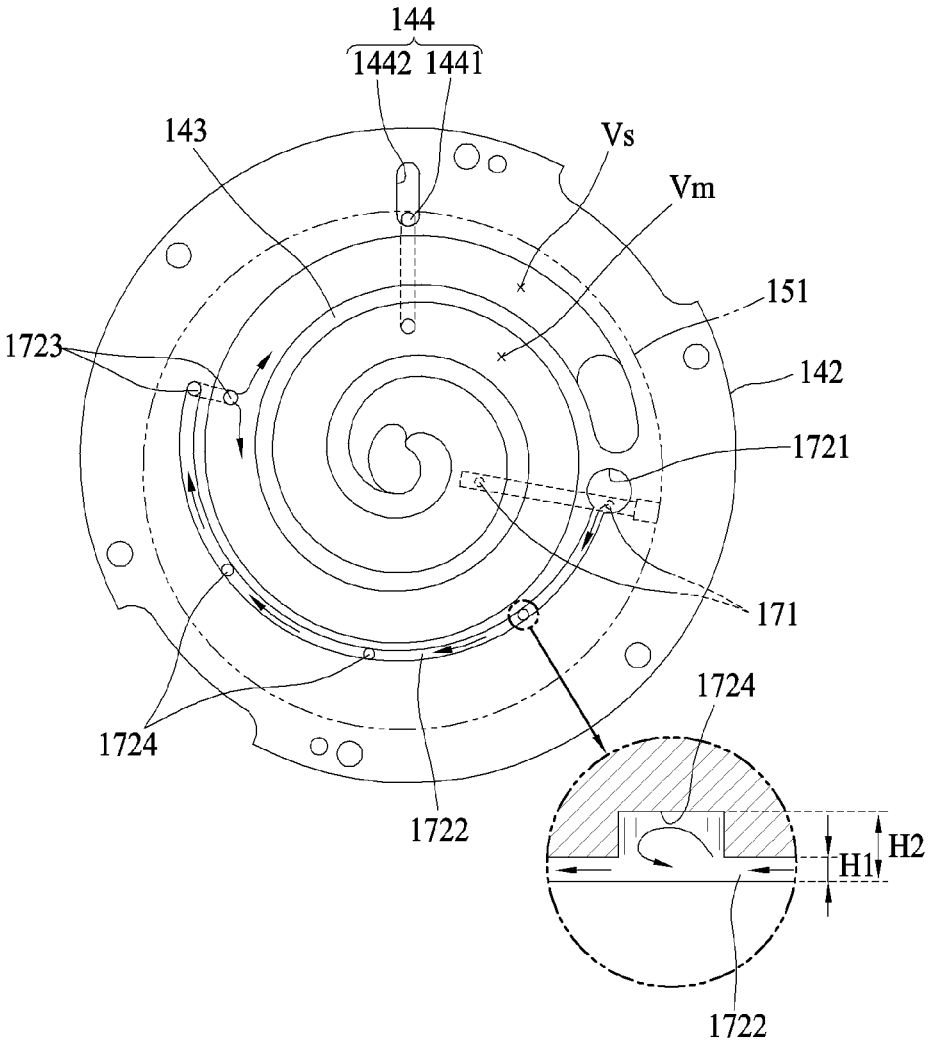

FIGS. 6 through 8 are planar views of a second oil supply guide according to different embodiments. Referring to FIGS. 6 through 8, second oil supply passage 170 according to this embodiment may include first oil supply guide 171 and second oil supply guide 172. The first oil supply guide 171 may be disposed in the orbiting scroll 150, with one or a first end that communicates with the oil storage space S1 defined in the lower space 110*d* of the casing 110 through the oil supply hole 1255 of the rotational shaft 125, and the second oil supply guide 172 may be disposed in the fixed scroll 140, with one or a first end that communicates with the first oil supply guide 171 and another or a second end with the compression chamber V1, V2. Accordingly, a pressure difference between both ends of the second oil supply passage 170 through which oil is supplied to the second thrust bearing surface B2 may increase, enabling oil to be supplied smoothly and quickly to the second oil supply guide 172 through the first oil supply guide 171. As the basic configuration and resulting operating effects of the first oil supply guide 171 and the second oil supply guide 172 are similar to those of the previous embodiment, relevant description will be replaced by the description of the previous embodiment.

The second oil supply guide 172 according to this embodiment may include oil supply connection groove 1721, oil supply extension groove 1722, and oil supply connection hole 1723. The oil supply connection groove 1721, the oil extension groove 1722, and the oil supply connection hole 1723 may be formed in the fixed thrust surface 142*a* that forms the second thrust bearing surface B2 together with the orbiting thrust surface 151*a*. The basic shape and operating effects of the oil supply connection groove 1721, the oil supply extension groove 1722, and the oil supply connection hole 1723 are also similar to those of the previous embodiment. Relevant description will be replaced by the description of the previous embodiment.

However, as illustrated in FIG. 6, the oil supply extension groove 1722 may be formed to have different cross-sectional areas between both ends thereof. For example, the cross-sectional area of the oil supply extension groove 1722 on the side of the oil supply connection hole 1723 may be smaller than the cross-sectional area of the oil supply extension groove 1722 on the opposite side, namely, on the side of the oil supply connection groove 1721, thereby forming at least one step surface 1722*a* in the middle of the oil supply extension groove 1722. Accordingly, oil that flows toward the oil supply connection hole 1723 along the oil supply extension groove 1722 may form a kind of vortex on the step surface 1722*a*, lowering the pressure of the oil and further reducing suction loss in the compression chamber V.

In addition, when the cross-sectional area on the side of the second end of the oil supply extension groove 1722 is formed small as illustrated in FIG. 6, a sealing distance from the oil supply extension groove 1722 may be secured at a minimum sealing point. Accordingly, the oil supply extension groove 1722 may extend further from the oil supply connection groove 1721, thereby further increasing a lubrication area on the second thrust bearing surface B2.

Also, as illustrated in FIGS. 7 and 8, at least one oil supply expansion groove 1724 may be formed in the middle of the oil supply extension groove 1722. For example, as illustrated in FIG. 7, a radial width D2 of the oil supply expansion groove 1724 may be wider than a radial width D1 of the oil supply extension groove 1722 on both front and rear sides, and as illustrated in FIG. 8, an axial depth H2 of the oil supply expansion groove 1724 may be deeper than an axial depth H1 of the oil supply extension groove 1722 on both front and rear sides. Even in these cases, the pressure of oil moving toward the oil supply connection hole 1723 along the oil supply extension groove 1722 may be lowered, further reducing suction loss in the compression chamber V1, V2.

Hereinafter, description will be given of an oil supply passage according to still another embodiment. That is, in the previous embodiment, the second end of the oil supply extension groove communicates with the compression chamber through the oil supply connection hole, but in some cases, the oil supply extension groove may directly communicate with the compression chamber.

Figure 9:
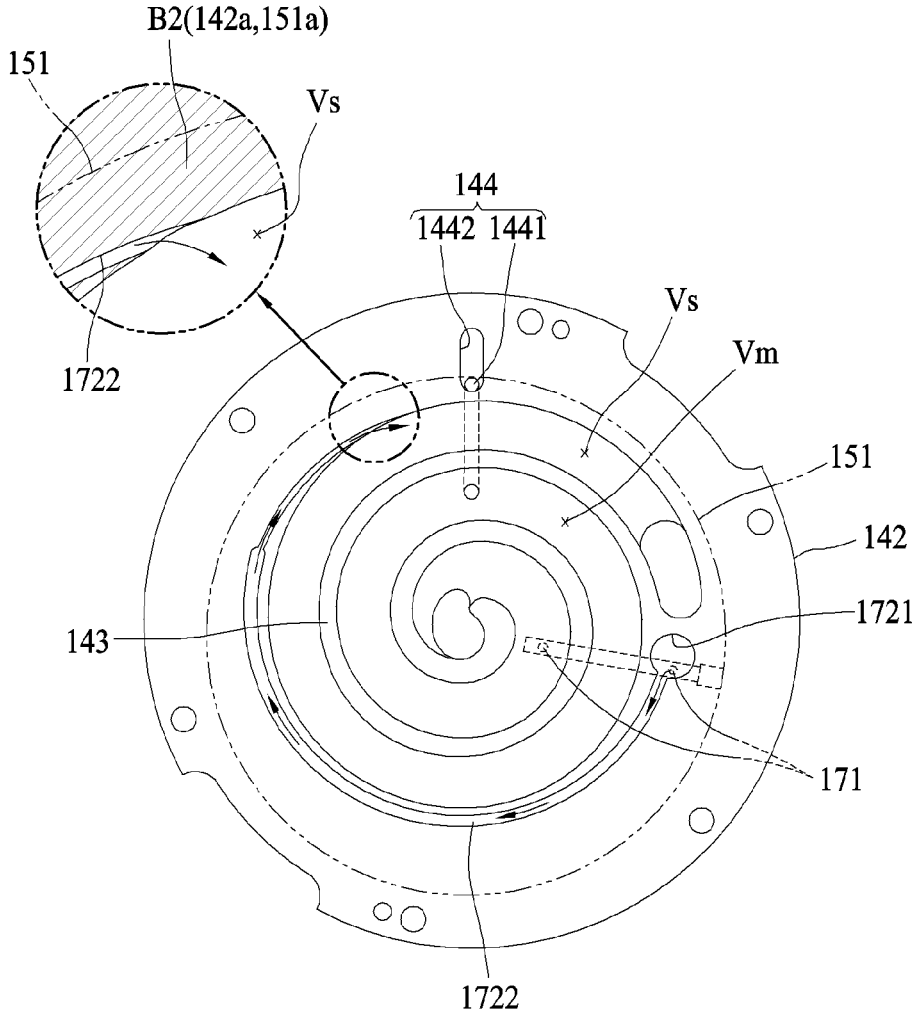
FIGS. 9 and 10 are planar views of a second oil supply guide according to different embodiments.
Figure 10:
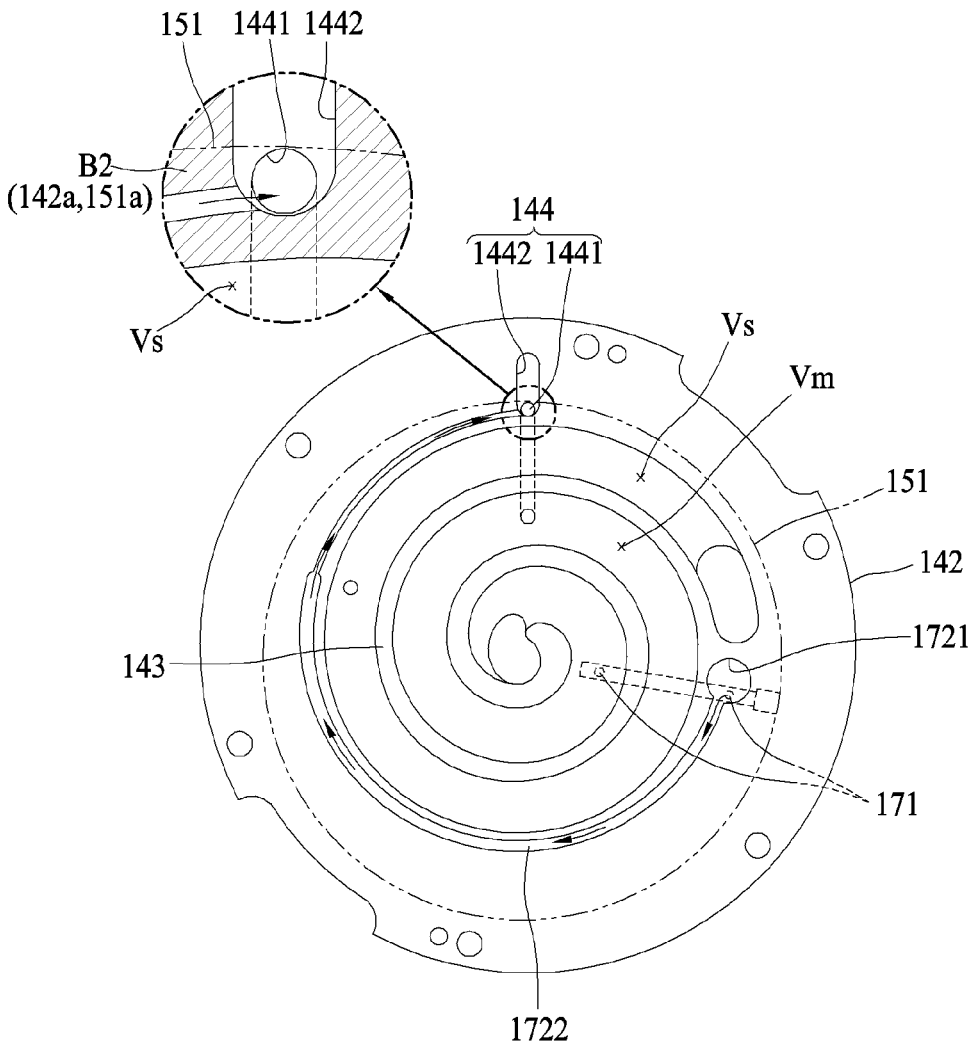

FIGS. 9 and 10 are planar views of a second oil supply guide according to different embodiments. Referring to FIGS. 9 and 10, second oil supply passage 170 according to this embodiment may include first oil supply guide 171 and second oil supply guide 172. The first oil supply guide 171 may be disposed in the orbiting scroll 150, with one or a first end that communicates with the oil storage space S1 of the casing 110 through the oil supply hole 1255 of the rotational shaft 125, and the second oil supply guide 172 may be disposed in the fixed scroll 140, with one or a first end that communicates with the first oil supply guide 171 and another or a second end with the compression chamber V1, V2. Accordingly, a pressure difference between both ends of the second oil supply passage 170 through which oil is supplied to the second thrust bearing surface B2 may increase, enabling oil to be supplied smoothly and quickly to the second oil supply guide 172 through the first oil supply guide 171. As the basic configuration and resulting operating effects of the first oil supply guide 171 and the second oil supply guide 172 are similar to those of the previous embodiment, relevant description will be replaced by the description of the previous embodiment.

However, the second oil supply guide 172 according to this embodiment may include oil supply connection groove 1721 and oil supply extension groove 1722. In other words, the oil supply connection hole 1723 in the previous embodiments of FIGS. 2 to 8 is excluded from this embodiment, and the second end of the oil supply extension groove 1722 may be connected to the inner circumferential surface of the fixed side wall portion 142, which defines the outermost fixed wrap, to communicate with the compression chamber V1, V2. Accordingly, the first end of the oil supply extension groove 1722 may be connected to the oil supply connection groove 1721, and the second end of the oil supply extension groove 1722 may directly communicate with the compression chamber V1, V2. With this structure, the second oil supply guide 172 may be easily formed by the exclusion of the oil supply connection hole 1723 which is provided in the previous embodiments.

In addition, in a case in which the second end of the oil supply extension groove 1722 is directly connected to the compression chamber V1, V2 as described above, the second end of the oil supply extension groove 1722 may communicate with a compression chamber before suction completion, in other words, a compression chamber (hereinafter, referred to as a "suction pressure chamber") forming a suction pressure. Accordingly, as the oil supply extension groove 1722 is recessed into the inner circumferential surface of the fixed side wall portion 142 and communicates with the compression chamber V1, V2, the oil supply extension groove 1722 may alternately communicate with the first compression chamber V1 and the second compression chamber V2 in the suction pressure chamber Vs even when communicating with the compression chambers V1 and V2.

Additionally, in this case, as the oil supply extension groove 1722 is in direct communication with the suction pressure chamber Vs, relatively high-temperature and high-pressure oil may flow directly into the suction pressure chamber Vs. This may increase a specific volume of refrigerant in the suction pressure chamber Vs, thereby causing suction loss.

Accordingly, as illustrated in FIG. 9, the oil supply extension groove 1722 may be formed, as in the embodiment of FIG. 6, such that a cross-sectional area of the oil supply extension groove 1722 on a side of the suction pressure chamber Vs is smaller than a cross-sectional area of the oil supply extension groove 1722 on an opposite side. This may further extend a length of the oil supply extension groove 1722 to increase a lubrication area and lower the pressure of oil introduced into the suction pressure chamber Vs, thereby suppressing or preventing the occurrence of suction loss.

As illustrated in FIG. 10, the oil supply extension groove 1722 may communicate even with back pressure passage 144. As described above, the back pressure passage 144 may include back pressure connection hole 1441 and back pressure connection groove 1442. The back pressure connection hole 1441 may communicate with the intermediate pressure chamber Vm through the fixed end plate 141, and the back pressure connection groove 1442 may be recessed into the fixed thrust surface 142*a* and connected to the back pressure connection hole 1441 to communicate with the back pressure space portion 133.

In this case, another or second end of the oil supply extension groove 1722 may be recessed and connected to the inner surface of the back pressure connection groove 1442. Even in this case, the cross-sectional area of the oil supply extension groove 1722 on the suction pressure chamber side may be smaller than the cross-sectional area of the oil supply extension groove 1722 on the opposite side. This may further extend the length of the oil supply extension groove 1722 to increase the lubrication area and lower the pressure of oil introduced into the suction pressure chamber Vs, thereby suppressing or preventing the occurrence of suction loss.

Additionally, in this case, the oil supply extension groove 1722 may be formed to have a cross-sectional area that is smaller than or equal to the cross-sectional area of the back pressure connection groove 1442. Accordingly, the pressure of oil moving toward the back pressure connection groove 1772 through the oil supply extension groove 1722 may be lowered to expand the lubrication area, and also suppress or prevent an excessive increase in pressure in the intermediate pressure chamber Vm or pressure in the back pressure chamber.

Hereinafter, description will be given of an oil supply passage according to still another embodiment. That is, in the previous embodiments, the first oil supply guide is formed in the orbiting scroll and the second oil supply guide is formed in the fixed scroll 140; however, in some cases, portions of the first oil supply guide and the second oil supply guide may be formed in the orbiting scroll.

Figure 11:
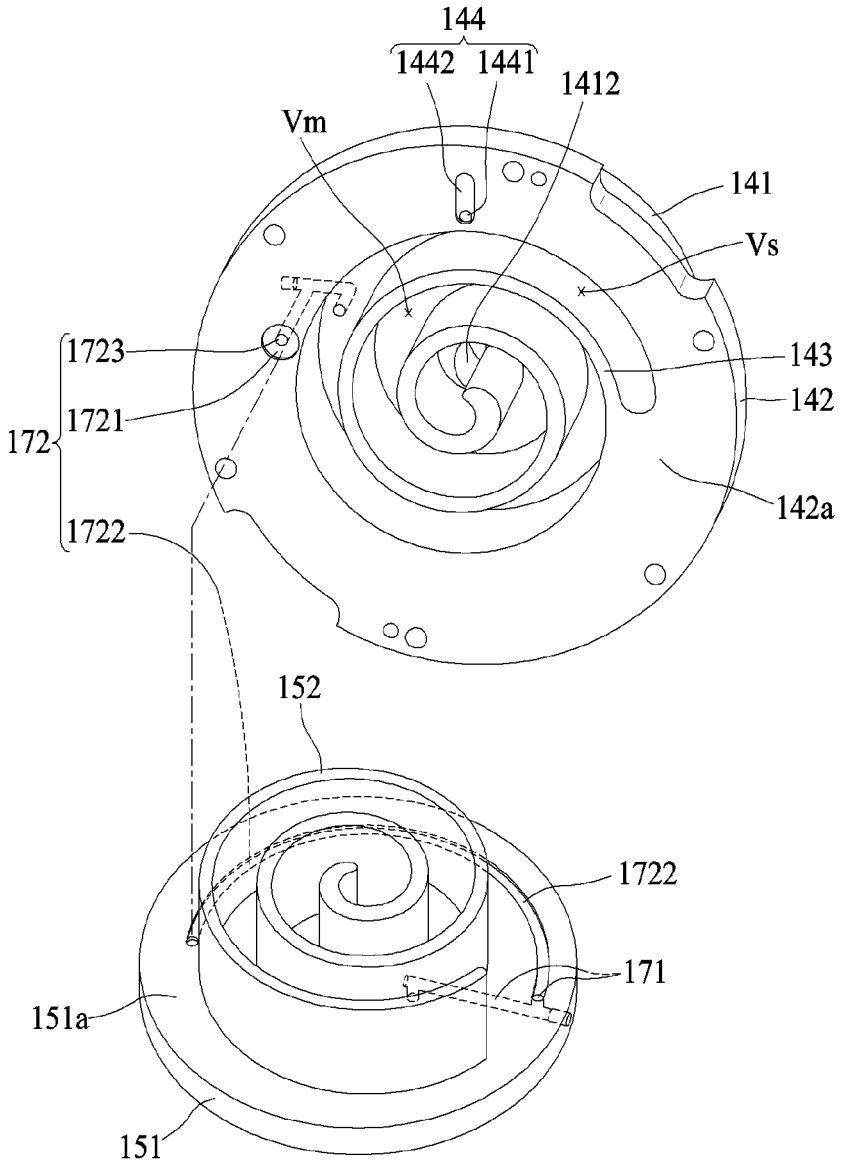
FIG. 11 is an exploded perspective view of a second oil supply guide according to another embodiment.
Figure 12:
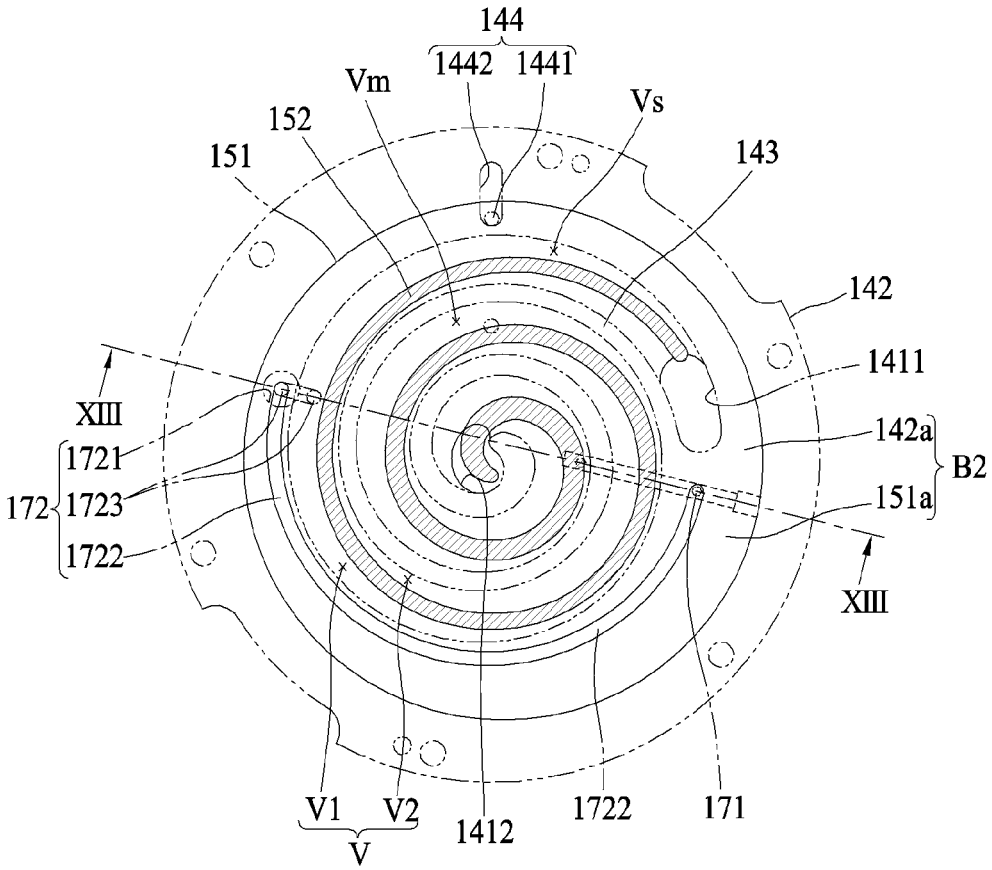
FIG. 12 is an assembled planar view of FIG. 11.

FIG. 11 is an exploded perspective view of a second oil supply guide according to another embodiment. FIG. 12 is an assembled planar view of FIG. 11, and FIG. 13 is a cross-sectional view, taken along line "XIII-XIII" of FIG. 12.

Figure 13:
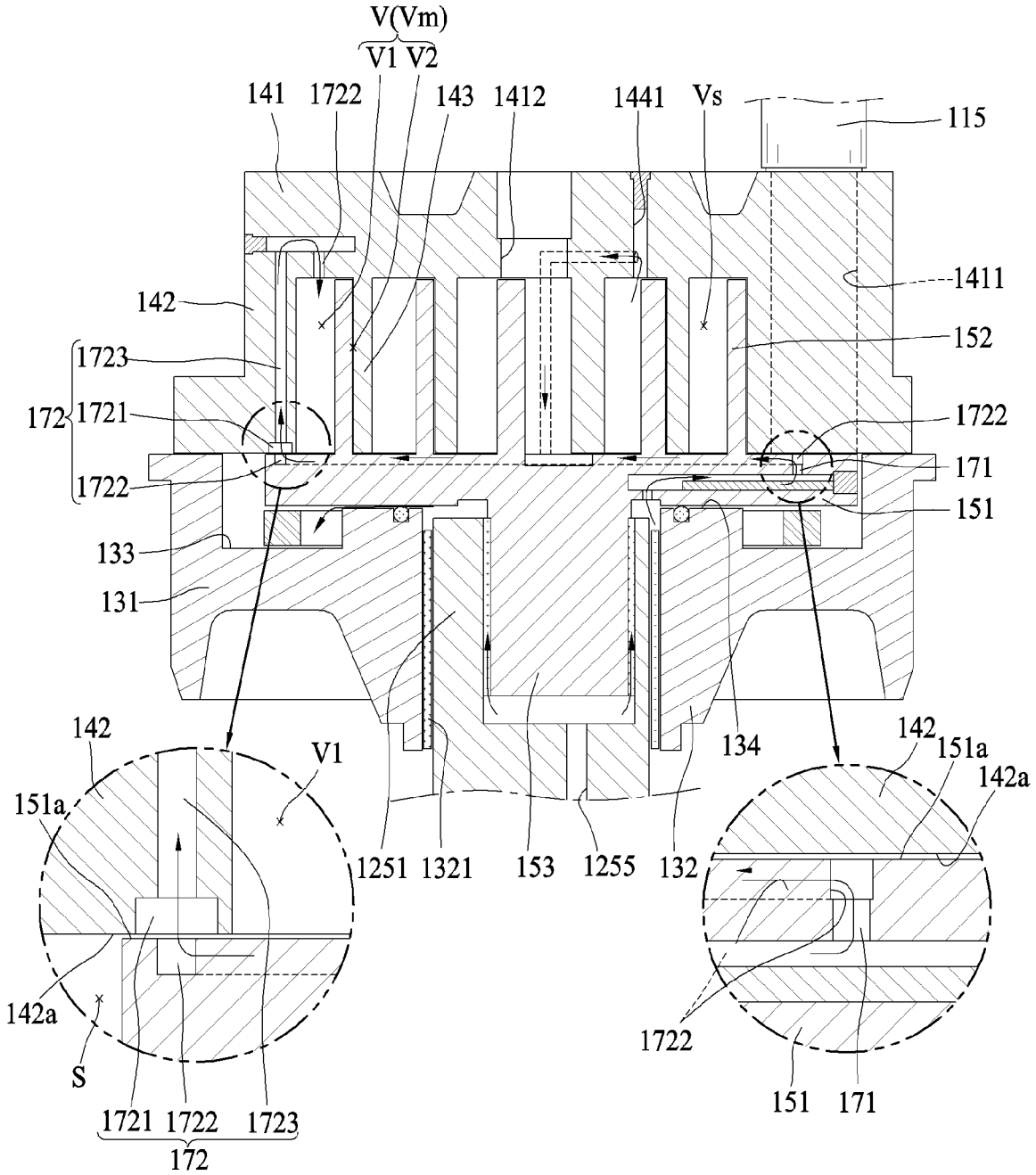
FIG. 13 is a cross-sectional view, taken along line "XIII-XIII" of FIG. 12.

Referring to FIGS. 11 through 13, the second oil supply passage 170 according to this embodiment may include first oil supply guide 171 and second oil supply guide 172. This is the same as that in the previous embodiments. For example, the first oil supply guide 171 has one or a first end that communicates with the oil storage space S1 of the casing 110 through the oil supply hole 1255 of the rotational shaft 125, and the second oil supply guide 172 has one or a first end that communicates with the first oil supply guide 171 and another or a second end with the compression chamber V1, V2. Accordingly, a pressure difference between both ends of the second oil supply passage 170 through which oil is supplied to the second thrust bearing surface B2 may increase, enabling oil to be supplied smoothly and quickly to the second oil supply guide 172 through the first oil supply guide 171. As the basic configuration and resulting operating effects of the first oil supply guide 171 and the second oil supply guide 172 are similar to those of the previous embodiments, relevant description will be replaced by the description of the previous embodiments.

However, in this embodiment, the first oil supply guide 171 may be disposed in the orbiting scroll 150, and the second oil supply guide 172 may be disposed partially in the orbiting scroll 150 and partially in the fixed scroll 140. In other words, in the previous embodiments, the second oil supply guide 172 may be disposed in the fixed scroll 140, but in this embodiment, a portion of the second oil supply guide 172 may be formed in the orbiting scroll 150.

For example, the second oil supply guide 172 according to this embodiment may include an oil supply extension groove 1722 and an oil supply connection hole 1723, and the oil supply extension groove 1722 may be formed in the orbiting scroll 150 and the oil supply connection hole 1723 in the fixed scroll 140. In other words, the oil supply extension groove 1722 of the second oil supply guide 172 according to this embodiment may be formed in the orbiting scroll 150 and directly connected to the first oil supply guide 171. Accordingly, the oil supply connection groove 1721 in the previous embodiments may be excluded, and the inlet of the second oil supply guide 172 may be directly connected to the second end of the first oil supply guide 171.

The oil supply extension groove 1722 may be formed in the orbiting thrust surface 151*a* forming the second thrust bearing surface B2. For example, one or a first end of the oil supply extension groove 1722 may be connected to the second end of the oil supply guide 171, which defines an outlet, and may extend along the outer circumferential surface of the outermost orbiting wrap 152 at a spacing from the outer circumferential surface of the outermost orbiting wrap 152. Accordingly, oil flowing into the oil supply extension groove 1722 through the first oil supply guide 171 lubricates the second thrust bearing surface B2 while moving along the oil supply extension groove 1722.

The oil supply extension groove 1722 may be formed to have a same cross-sectional area or different cross-sectional areas between both ends. In other words, the oil supply extension groove 1722 is different only in its formation position, but its basic configuration and resulting operating effects are the same as those in the embodiments of FIGS. 2 to 8, relevant description will be replaced by the description of the previous embodiments.

One or a first end of the oil supply connection hole 1723 may communicate with the oil supply extension groove 1722 and another or a second end may communicate with the compression chamber. In other words, the first end of the oil supply connection hole 1723 may communicate with the second end of the oil supply extension groove 1722 through the fixed thrust surface 142*a* and the second end of the oil supply connection hole 1723 may be formed to penetrate the compression chamber V1, V2 at an inner side of the outermost fixed wrap 143. As the basic configuration and resulting operating effects of the oil supply connection hole 1723 are the same as those in the embodiments of FIGS. 2 to 8, relevant description will be replaced by the description of the previous embodiments.

However, the oil supply connection groove 1721 may extend from the first end of the oil supply hole 1723, that is, from the end portion of the oil supply connection hole 1723, which is connected to the second end of the oil supply extension groove 1722. For example, a width of the oil supply extension groove 1722 and an inner diameter of the oil supply connection hole 1723 may be smaller than an orbiting radius of the orbiting scroll 150, but the oil supply connection groove 1721 may be enlarged by the orbiting radius. Accordingly, the oil supply connection hole 1723 may be continuously connected to the oil supply extension groove 1722 disposed in the orbiting scroll 150.

As described above, even when the portion of the second oil supply passage 170, for example, the oil supply extension groove 1722, is formed in the orbiting thrust surface 151*a*, which is the upper surface of the orbiting end plate 151, the operating effects are similar to those in the previous embodiments. However, in this embodiment, as the oil supply extension groove 1722 is formed in the upper surface of the orbiting end plate 151, that is, in the orbiting thrust surface 151*a*, oil flowing into the second oil supply passage 170 may be submerged in the oil supply extension groove 1722 by its own weight.

Accordingly, during operation, oil in the oil supply extension groove 1722 may spread widely on the second thrust bearing surface B2 by receiving centrifugal force, to effectively lubricate the second thrust bearing surface B2. In addition, even when the compressor is stopped, a certain amount of oil may be stored in the second oil supply passage (oil supply extension groove) 170. Upon restarting the compressor, the stored oil may be quickly supplied onto the second thrust bearing surface B2. With this structure, when the oil supply extension groove 1722 is formed in the orbiting scroll 150 as in this embodiment, friction loss and/or wear on the second thrust bearing surface B2 may be more effectively suppressed or prevented.

Although not illustrated in the drawings, the second end of the oil supply extension groove 1722 may directly communicate with the suction pressure chamber Vs, as illustrated in FIG. 9, or may be connected to the back pressure passage 144, as illustrated in FIG. 10. In this case, only the location of the oil supply extension groove 1722 is different, and its configuration and effects are similar to those of FIGS. 9 and 10 described above.

Hereinafter, description will be given of an oil supply passage according to still another embodiment. That is, in the previous embodiments, the first oil supply guide is formed in the orbiting scroll and all or portion of the second oil supply guide is formed in the fixed scroll 140, but in some cases, both the first oil supply guide and the second oil supply guide may be formed in the orbiting scroll.

Figure 14:
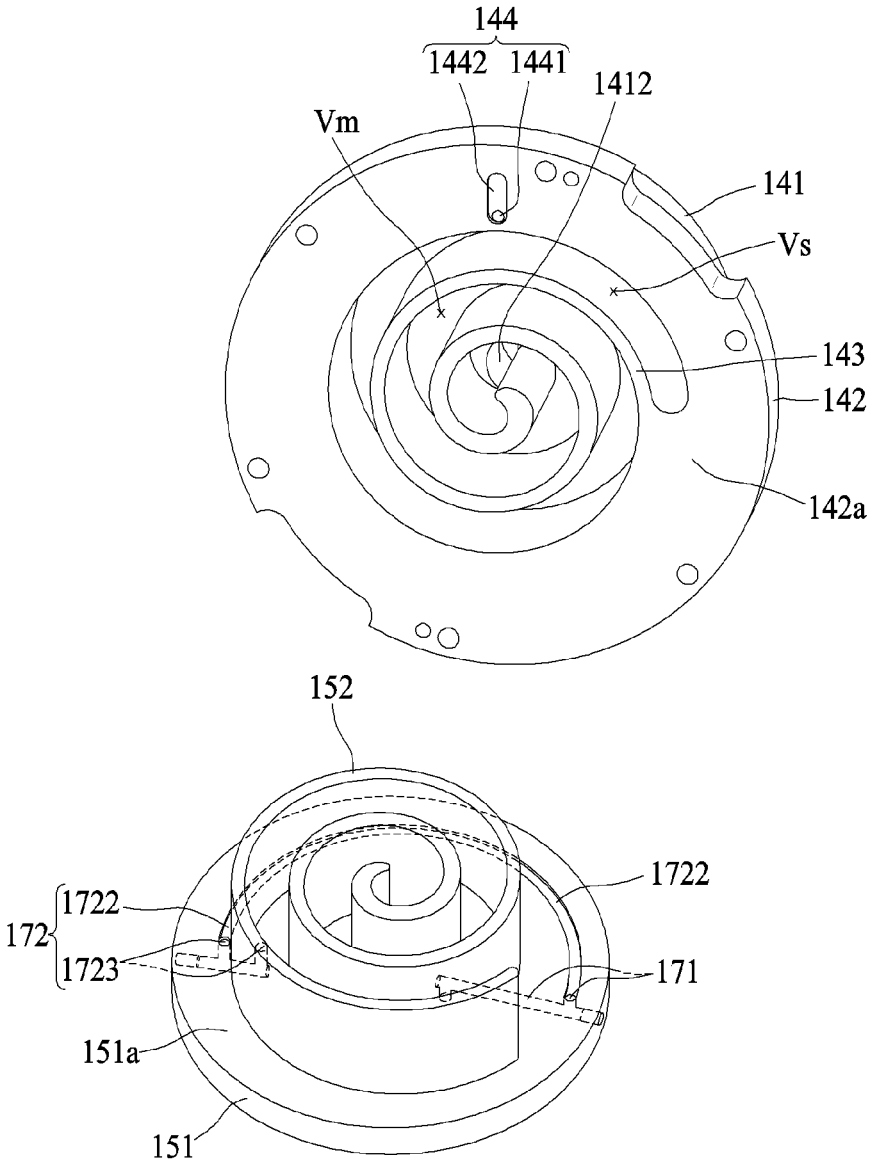
FIG. 14 is an exploded perspective view a second oil supply guide according to another embodiment.
Figure 15:
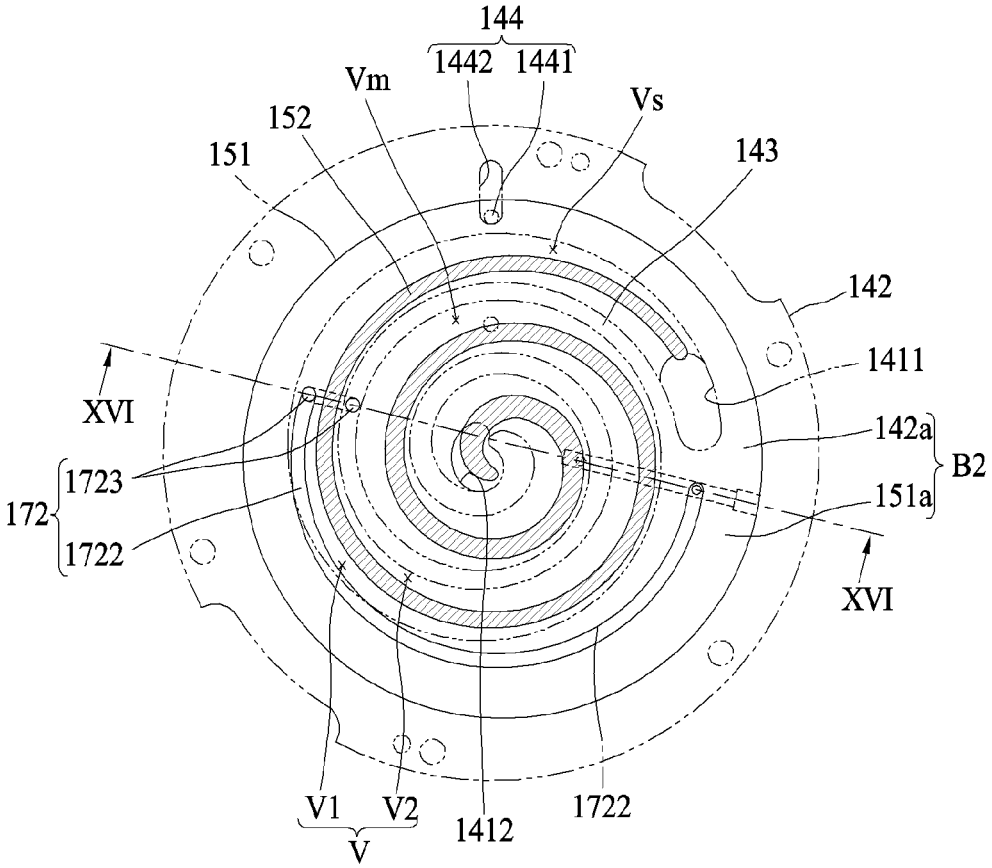
FIG. 15 is an assembled planar view of FIG. 14.

FIG. 14 is an exploded perspective view of a second oil supply guide according to another embodiment. FIG. 15 is an assembled planar view of FIG. 14, and FIG. 16 is a cross-sectional view, taken along line "XVI-XVI" of FIG. 15.

Figure 16:
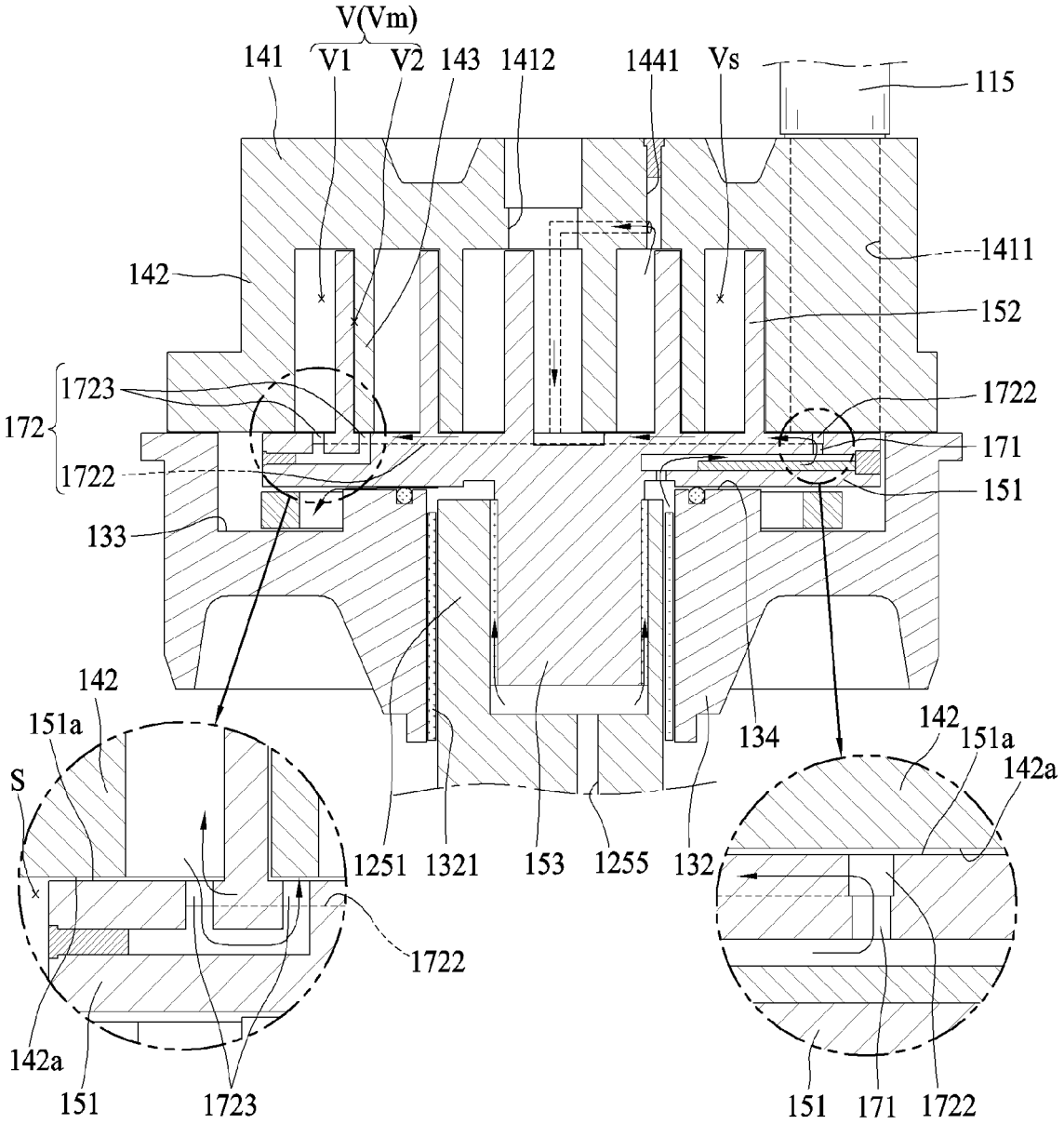
FIG. 16 is a cross-sectional view, taken along line "XVI-XVI" of FIG. 15.

Referring to FIGS. 14 to 16, the second oil supply passage 170 according to this embodiment may include first oil supply guide 171 and second oil supply guide 172. The first oil supply guide 171 has one or a first end that communicates with the oil storage space S1 of the casing 110 through the oil supply hole 1255 of the rotational shaft 125, and the second oil supply guide 172 has one or a first end that communicates with the first oil supply guide 171 and another or a second end that communicates with the compression chamber V1, V2. Accordingly, a pressure difference between both ends of the second oil supply passage 170 through which oil is supplied to the second thrust bearing surface B2 may increase, enabling oil to be supplied smoothly and quickly to the second oil supply guide 172 through the first oil supply guide 171. As the basic configuration and resulting operating effects of the first oil supply guide 171 and the second oil supply guide 172 are similar to those of the previous embodiment of FIGS. 11 to 13, relevant description will be replaced by the description of the previous embodiment.

However, in this embodiment, both the first oil supply guide 171 and the second oil supply guide 172 may be disposed in the orbiting scroll 150. In other words, in the embodiment of FIGS. 11 to 13, the portion of the second oil supply guide 172 may be disposed in the fixed scroll 140, but in this embodiment, the entire second oil supply guide 172 may be formed in the orbiting scroll 150.

For example, the second oil supply guide 172 according to this embodiment may include oil supply extension groove 1722 and oil supply connection hole 1723, and the oil supply extension groove 1722 and the oil supply connection hole 1723 may be formed in the fixed scroll 150. In other words, the oil supply extension groove 1722 and the oil supply connection hole 1723 of the second oil supply guide 172 according to this embodiment may be formed in the orbiting scroll 150 and directly connected to the first oil supply guide 171. Accordingly, as illustrated in FIGS. 11 to 13, the oil supply connection groove 1721 of the embodiments of FIGS. 2 to 10 may be excluded, and the inlet of the second oil supply guide 172 may be directly connected to the second end of the first oil supply guide 171.

The oil supply extension groove 1722 may be formed in the orbiting thrust surface 151*a* forming the second thrust bearing surface B2. As the basic configuration and resulting operating effects of the oil supply extension groove 1722 are similar to those in the embodiments of FIGS. 11 to 13, relevant description will be replaced by the description of the previous embodiment of FIGS. 11 to 13. However, the oil supply extension groove 1722 according to this embodiment may be formed such that the second end thereof is adjacent to the outer circumferential surface of the outermost orbiting wrap 142, for example, is disposed at an edge where the orbiting thrust surface 151*a* and the outer circumferential surface of the outermost orbiting wrap 152 meet. Accordingly, during the orbital movement of the orbiting scroll 150, the second end of the oil supply extension groove 1722 and/or the vicinity of the second end of the oil supply extension groove 1722 may be in communication with the first compression chamber V1.

One or a first end of the oil supply connection hole 1723 may communicate with the oil supply extension groove 1722 and another or a second end may communicate with the compression chamber. In other words, the first end of the oil supply connection hole 1723 may communicate with the second end of the oil supply extension groove 1722 through the orbiting thrust surface 151*a*, and the second end of the oil supply connection hole 1723 may be formed to penetrate the second compression chamber V2 at the edge where the inner circumferential surface of the outermost orbiting wrap 152 and the orbiting end plate 151 meet. The oil supply connection hole 1723 is different only in its formation position, and as the basic configuration and operating effects thereof are similar to those in the embodiment of FIGS. 11 to 13 described above, relevant description will be replaced by the description of the previous embodiment.

As described above, even when the second oil supply passage 170 is formed through the orbiting thrust surface 151*a*, which is the upper surface of the orbiting end plate 151, its effects are similar to those in the previous embodiments, especially, the embodiment of FIGS. 11 to 13. However, in this embodiment, as the oil supply extension groove 1722 and the oil supply connection hole 1723 are formed in the orbiting scroll 150, it may be unnecessary to separately form a portion of the second oil supply passage 170 in the fixed scroll 140. This may facilitate machining of the fixed scroll 140. In addition, as both the first oil supply guide 171 and the second oil supply guide 172 are formed in the orbiting scroll 150, oil leakage between both the oil supply guides 171 and 172 may be prevented, thereby enhancing an oil supply effect.

Embodiments disclosed herein provide a scroll compressor that is capable of smoothly supplying oil to a thrust bearing surface between a fixed scroll and an orbiting scroll.

Embodiments disclosed herein also provide a scroll compressor that is capable of smoothly supplying oil of a casing to a thrust bearing surface between a fixed scroll and an orbiting scroll by increasing a pressure difference in an oil supply guide unit which guides oil to the thrust bearing surface.

Embodiments disclosed herein further provide a scroll compressor that is capable of securing a suction volume of a compression chamber as large as possible while smoothly supplying oil to a thrust bearing surface between a fixed scroll and an orbiting scroll.

Embodiments disclosed herein furthermore provide a scroll compressor that is capable of securing a suction volume of a compression chamber as large as possible and making a length of an oil supply guide unit as long as possible in a thrust bearing surface between a fixed scroll and an orbiting scroll.

Embodiments disclosed herein also provide a scroll compressor that is capable of quickly lubricating a thrust bearing surface between a fixed scroll and an orbiting scroll upon restart of the compressor by storing a large amount of oil in an oil supply guide unit even in a stopped state.

Embodiments disclosed herein provide a scroll compressor that may include a casing, a main frame, a rotational shaft, an orbiting scroll, a fixed scroll, and an oil supply guide portion or guide. The case may have an oil storage space. The main frame may be fixed to an inside of the casing. The rotational shaft may be inserted through the main frame to be supported and may have an oil supply hole therein. The orbiting scroll may be eccentrically coupled to the rotational shaft so that one side surface thereof is axially supported on the main frame. The fixed scroll may be disposed on an opposite side of the main frame with the orbiting scroll interposed therebetween to form a compression chamber together with the orbiting scroll. The oil supply guide portion may be disposed in at least one of the orbiting scroll or the fixed scroll, and communicate with the oil supply hole to guide oil in the oil storage space to a thrust bearing surface between the orbiting scroll and the fixed scroll. The oil supply guide portion may include a first oil supply guide portion or guide and a second oil supply guide portion or guide. The first oil supply guide may be disposed in the orbiting scroll, and may communicate with the oil supply hole of the rotational shaft. The second oil supply guide portion may be disposed in at least one of the orbiting scroll or the fixed scroll, and extend along the thrust bearing surface such that the first oil supply guide portion communicates with a compression chamber having a pressure lower than a pressure in the oil storage space. This may generate a great pressure difference between both ends of an oil supply passage including the first oil supply guide portion and the second oil supply guide portion, and allow a smooth oil supply using differential pressure to the thrust bearing surface between the fixed scroll and the orbiting scroll.

The fixed scroll may have a fixed thrust surface that is slidably in contact with an orbiting thrust surface of the orbiting scroll to define the thrust bearing surface. The second oil supply guide portion may include an oil supply connection groove and an oil supply extension groove. The oil supply connection groove may be recessed by a preset or predetermined depth into the fixed thrust surface. The oil supply extension groove may have one or a first end that communicates with the oil supply connection groove and another or a second end that communicates with the compression chamber with being spaced apart from the oil supply connection groove. The oil supply extension groove may be formed to overlap the orbiting thrust surface in an axial direction between the both ends thereof. With this structure, the oil supply extension groove defining a substantial oil supply passage may always be covered and maintained in a sealed state between both thrust surfaces, thereby maintaining a high pressure difference between both ends of the oil supply passage.

The oil supply connection groove may be formed such that at least a portion thereof overlaps an orbiting trajectory of an end of the first oil supply guide. A radial width of the oil supply extension groove may be smaller than a radial width of the oil supply connection groove. With this structure, the oil supply extension groove may always be covered and maintained in a sealed state between both thrust surfaces, thereby maintaining a high pressure difference between both ends of an oil supply passage.

The oil supply extension groove may have a same cross-sectional area between both ends thereof. This may facilitate machining of the oil supply extension groove and simultaneously enable a certain amount of oil to flow into the oil supply extension groove to stably lubricate the thrust bearing surface.

Also, the oil supply extension groove may be formed such that a cross-sectional area of a portion toward the oil supply connection groove is smaller than a cross-sectional area of a portion toward the compression chamber. With this structure, oil that flows along the oil supply extension groove may form a kind of vortex in the middle of the oil supply extension groove, which may lower a pressure of the oil, thereby further reducing suction loss in the compression chamber.

Further, at least one oil supply expansion groove may be formed between the both ends of the oil supply extension groove. The oil supply expansion groove may have a cross-sectional area larger than a cross-sectional area of the oil supply extension groove. This may lower the pressure of oil that flows along the oil supply extension groove, thereby further reducing suction loss in the compression chamber.

An oil supply connection hole may be disposed in the another end of the oil supply extension groove such that the oil supply extension groove communicates with the compression chamber. The oil supply connection hole may be formed to penetrate between the fixed thrust surface and the compression chamber. Accordingly, the ends of the oil supply passage may alternately communicate with both compression chambers, and thus, a pressure difference may be constantly maintained between the both ends of the oil supply passage, thereby increasing uniformity of oil supply to the thrust bearing surface.

The oil supply connection hole may communicate with the compression chamber after suction is completed. This may suppress or prevent introduction of high-temperature and high-pressure oil into a suction pressure chamber while maintaining a pressure difference as great as possible between both ends of the oil supply passage, thereby reducing suction loss.

A back pressure space portion defining a back pressure chamber may be formed between the main frame and the orbiting scroll, and a back pressure passage portion or passage through which the back pressure space portion communicates with the compression chamber may be formed in the fixed scroll to penetrate between the compression chamber and the fixed thrust surface. The oil supply connection hole may communicate with the compression chamber with being spaced apart from the back pressure passage portion. With this structure, the end of the oil supply passage may communicate with a compression chamber forming an intermediate pressure chamber, so as to suppress or prevent introduction of high-temperature and high-pressure oil into a suction pressure chamber while maintaining a great pressure difference between both ends of the oil supply passage, thereby reducing suction loss.

A fixed wrap may be formed on the fixed scroll, and engage with an orbiting wrap of the orbiting scroll to form the compression chamber. The another end of the oil supply extension groove may communicate with an inner circumferential surface of the fixed wrap extending from the fixed thrust surface. This may facilitate formation of the second oil supply guide portion by virtue of the exclusion of an oil supply connection hole, and also, make the oil supply extension groove as along as possible so as to secure a wide lubrication area.

The another end of the oil supply extension groove may communicate with the compression chamber before suction is completed. This may make the oil supply extension groove as long as possible, securing a wide lubrication area.

The oil supply extension groove may be formed such that a cross-sectional area at an end portion thereof toward the oil supply connection groove is smaller than a cross-sectional area at an end portion toward the compression chamber. With this structure, a length of the oil supply extension groove may be made as long as possible to secure a wide lubrication area, oil pressure in the oil supply extension groove may be lowered to reduce suction loss, and a minimum sealing distance with respect to the oil supply extension groove may be secured to make the oil supply extension groove as long as possible.

A back pressure space portion defining a back pressure chamber may be formed between the main frame and the orbiting scroll, and a back pressure passage portion or passage through which the back pressure space portion communicates with the compression chamber may be formed in the fixed scroll to penetrate between the compression chamber and the fixed thrust surface. The another end of the oil supply extension groove may communicate with the back pressure passage portion at the fixed thrust surface. This may facilitate formation of the second oil supply guide portion by virtue of the exclusion of an oil supply connection hole, and also, make the oil supply extension groove as along as possible so as to secure a wide lubrication area.

The back pressure passage portion may include a back pressure connection groove recessed into the fixed thrust surface. The oil supply extension groove may have a cross-sectional area smaller than or equal to a cross-sectional area of the back pressure connection groove. With this structure, a length of the oil supply extension groove may be made as long as possible to secure a wide lubrication area, oil pressure in the oil supply extension groove may be lowered to reduce suction loss, and a minimum sealing distance with respect to the oil supply extension groove may be secured to make the oil supply extension groove as long as possible.

The orbiting scroll may have an orbiting thrust surface that is slidably in contact with a fixed thrust surface of the fixed scroll to define the thrust bearing surface. The second oil supply guide portion may include an oil supply extension groove having one or a first end connected to the first oil supply guide portion and another or a second end that communicates with the compression chamber. The oil supply extension groove may be recessed by a preset or predetermined depth into the orbiting thrust surface to overlap the fixed thrust surface in an axial direction between the both ends thereof. With this structure, oil flowing into the oil supply passage may be stored in the oil supply extension groove and spread widely to the thrust bearing surface by centrifugal force and at the same time be quickly supplied to the thrust bearing surface when the compressor is restarted.

The oil supply extension groove may have a same cross-sectional area between the both ends thereof. This may facilitate machining of the oil supply extension groove and simultaneously allow a certain amount of oil to flow into the oil supply extension groove to stably lubricate the thrust bearing surface.

The oil supply extension groove may be formed such that a cross-sectional area of a portion toward the first oil supply guide portion is smaller than a cross-sectional area of a portion toward the compression chamber. With this structure, oil that flows along the oil supply extension groove may form a kind of vortex in the middle of the oil supply extension groove, which may lower a pressure of the oil, thereby further reducing suction loss in the compression chamber.

At least one oil supply expansion groove may be formed between the both ends of the oil supply extension groove. The oil supply expansion groove may have a cross-sectional area larger than a cross-sectional area of the oil supply extension groove. This may lower the pressure of oil that flows along the oil supply extension groove, thereby further reducing suction loss in the compression chamber.

For example, the fixed scroll or the orbiting scroll may include an oil supply connection hole through which the oil supply extension groove communicates with the compression chamber. The oil supply connection hole may communicate with the compression chamber after suction completion. This may suppress or prevent introduction of high-temperature and high-pressure oil into a suction pressure chamber while maintaining a pressure difference as great as possible between both ends of the oil supply passage, thereby reducing suction loss.

An oil supply connection hole may further be disposed in the another end of the oil supply extension groove such that the oil supply extension groove communicates with the compression chamber. The oil supply connection hole may be formed to penetrate between the fixed thrust surface and the compression chamber. With this structure, the oil supply extension groove forming a substantial oil supply passage may be formed in an orbiting thrust surface to enhance an oil supply effect, and simultaneously the ends of the oil supply passage may alternately communicate with both compression chambers to thus constantly maintain a pressure difference between the both ends of the oil supply passage, thereby increasing uniformity of oil supply to the thrust bearing surface.

An oil supply connection groove may be formed in the fixed thrust surface to communicate with the oil supply extension groove. The oil supply connection groove may be formed to be larger than a radial width of the oil supply extension groove so that at least a portion thereof overlaps an orbiting trajectory of the oil supply extension groove. With this structure, the oil supply extension groove may continuously communicate with the oil supply connection hole while forming the oil supply extension groove in the orbiting thrust surface, securing a pressure difference between both ends of the oil supply passage.

An oil supply connection hole may further be disposed in the another end of the oil supply extension groove such that the oil supply extension groove communicates with the compression chamber. The oil supply connection hole may be formed to penetrate between the orbiting thrust surface and the compression chamber. As the second oil supply guide portion is formed in the orbiting scroll, machining for the fixed scroll may be facilitated and the oil supply guide portions may be continuously connected, thereby improving oil supply stability.

The orbiting scroll may include an orbiting wrap that engages with a fixed wrap of the fixed scroll to form the compression chamber. The oil supply connection hole may have both ends that communicate respectively with an outer circumferential side and an inner circumferential side of the orbiting wrap connected to the orbiting thrust surface. With this structure, both ends of the second oil supply guide portion may alternately communicate with both compression chambers, thereby maintaining a great pressure difference between both ends of the oil supply passage.

The orbiting scroll may include an orbiting wrap that engages with a fixed wrap of the fixed scroll to form the compression chamber. The oil supply extension groove may communicate with the compression chamber at an outer circumferential side of the orbiting wrap connected to the orbiting thrust surface. This may make the oil supply extension groove as long as possible, securing a wide lubrication area.

The first oil supply guide portion may have one or a first end that penetrates one or a first side surface of the orbiting scroll to communicate with an oil supply passage of the rotational shaft, and another or a second end that penetrates another or a second side surface of the orbiting scroll to communicate with the second oil supply guide portion. The another end of the first oil supply guide portion may be formed such that at least a portion thereof continuously communicates with the one end of the second oil supply guide portion. With this structure, oil in the oil storage space may be quickly supplied to the thrust bearing surface through the first and second oil supply guide portions, and the first and second oil supply guide portions may be continuously connected to increase oil supply reliability.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having an oil storage space therein;

a main frame fixed inside of the casing;

a rotational shaft inserted through the main frame to be supported thereby and having an oil supply hole therein;

an orbiting scroll eccentrically coupled to the rotational shaft and having one side surface axially supported by the main frame;

a fixed scroll disposed on a same side of the main frame as the orbiting scroll interposed therebetween to form a compression chamber together with the orbiting scroll; and an oil supply guide disposed in at least one of the orbiting scroll or the fixed scroll, the oil supply guide communicating with the oil supply hole to guide oil in the oil storage space to a thrust bearing surface between the orbiting scroll and the fixed scroll, wherein the oil supply guide comprises:

a first oil supply guide disposed in the orbiting scroll and that communicates with the oil supply hole of the rotational shaft; and a second oil supply guide disposed in at least one of the orbiting scroll or the fixed scroll and that extends along the thrust bearing surface such that the first oil supply guide communicates with the compression chamber having a pressure lower than a pressure in the oil storage space, wherein the fixed scroll has a fixed thrust surface that is slidably in contact with an orbiting thrust surface of the orbiting scroll to define the thrust bearing surface, wherein a back pressure space portion defining a back pressure chamber is formed between the main frame and the orbiting scroll, and a back pressure passage through which the back pressure space portion communicates with the compression chamber is formed in the fixed scroll to penetrate between the compression chamber and the fixed thrust surface, wherein the second oil supply guide comprises:

an oil supply connection groove recessed into the fixed thrust surface or the orbiting thrust surface by a predetermined depth; and an oil supply extension groove having a first end that communicates with the oil supply connection groove and a second end that communicates with the compression chamber, wherein the second end of the oil supply extension groove is spaced apart from the oil supply connection groove, wherein the oil supply extension groove overlaps the orbiting thrust surface or the fixed thrust surface in an axial direction between ends thereof, and wherein the second end of the oil supply extension groove communicates with the back pressure passage at the fixed thrust surface.

2. The scroll compressor of claim 1, wherein at least a portion of the oil supply connection groove overlaps an orbiting trajectory of an end of the first oil supply guide, and wherein a radial width of the oil supply extension groove is smaller than a radial width of the oil supply connection groove.

3. The scroll compressor of claim 1, wherein the back pressure passage comprises a back pressure connection groove recessed into the fixed thrust surface, and wherein the oil supply extension groove has a cross-sectional area smaller than or equal to a cross-sectional area of the back pressure connection groove.

4. A scroll compressor, comprising:

a casing having an oil storage space therein;

a main frame fixed inside of the casing;

a rotational shaft inserted through the main frame to be supported thereby and having an oil supply hole therein;

an orbiting scroll eccentrically coupled to the rotational shaft and having one side surface axially supported by the main frame;

a fixed scroll disposed on a same side of the main frame as the orbiting scroll interposed therebetween to form a compression chamber together with the orbiting scroll; and an oil supply guide disposed in at least one of the orbiting scroll or the fixed scroll, the oil supply guide communicating with the oil supply hole to guide oil in the oil storage space to a thrust bearing surface between the orbiting scroll and the fixed scroll, wherein the oil supply guide comprises:

a first oil supply guide disposed in the orbiting scroll and that communicates with the oil supply hole of the rotational shaft; and a second oil supply guide disposed in at least one of the orbiting scroll or the fixed scroll and that extends along the thrust bearing surface such that the first oil supply guide communicates with the compression chamber having a pressure lower than a pressure in the oil storage space, wherein the orbiting scroll has an orbiting thrust surface that is slidably in contact with a fixed thrust surface of the fixed scroll to define the thrust bearing surface, wherein the second oil supply guide comprises an oil supply extension groove having a first end connected to the first oil supply guide and a second end that communicates with the compression chamber, wherein the oil supply extension groove is recessed by a predetermined depth into the orbiting thrust surface to overlap the fixed thrust surface in an axial direction between ends thereof, wherein at least one oil supply expansion groove is formed between the first and second ends of the oil supply extension groove, and wherein the at least one oil supply expansion groove has a cross-sectional area larger than a cross-sectional area of the oil supply extension groove.

5. The scroll compressor of claim 4, wherein the oil supply extension groove has a same cross-sectional area along a length thereof, or is formed such that a cross-sectional area at a portion toward the first oil supply guide is smaller than a cross-sectional area of a portion toward the compression chamber.

6. The scroll compressor of claim 4, wherein at least one of the fixed scroll or the orbiting scroll comprises an oil supply connection hole through which the oil supply extension groove communicates with the compression chamber, and wherein the oil supply connection hole communicates with the compression chamber after suction completion.

7. The scroll compressor of claim 4, wherein an oil supply connection hole is disposed at the second end of the oil supply extension groove such that the oil supply extension groove communicates with the compression chamber, and wherein the oil supply connection hole extends between the fixed thrust surface and the compression chamber.

8. A scroll compressor, comprising:

a casing having an oil storage space therein;

a main frame fixed inside of the casing;

a rotational shaft inserted through the main frame to be supported thereby and having an oil supply hole therein;

an orbiting scroll eccentrically coupled to the rotational shaft and having one side surface axially supported by the main frame;

a fixed scroll disposed on a same side of the main frame as the orbiting scroll interposed therebetween to form a compression chamber together with the orbiting scroll; and an oil supply guide disposed in at least one of the orbiting scroll or the fixed scroll, the oil supply guide communicating with the oil supply hole to guide oil in the oil storage space to a thrust bearing surface between the orbiting scroll and the fixed scroll, wherein the oil supply guide comprises:

a first oil supply guide disposed in the orbiting scroll and that communicates with the oil supply hole of the rotational shaft; and a second oil supply guide disposed in at least one of the orbiting scroll or the fixed scroll and that extends along the thrust bearing surface such that the first oil supply guide communicates with the compression chamber having a pressure lower than a pressure in the oil storage space, wherein a first end of the first oil supply guide penetrates a first side surface of the orbiting scroll to communicate with an oil supply passage of the rotational shaft, wherein a second end of the first oil supply guide penetrates a second side surface of the orbiting scroll to communicate with the second oil supply guide, wherein the second end of the first oil supply guide is formed such that at least a portion thereof continuously communicates with the first end of the second oil supply guide, wherein the fixed scroll has a fixed thrust surface that is slidably in contact with an orbiting thrust surface of the orbiting scroll to define the thrust bearing surface, wherein the second oil supply guide comprises:

an oil supply connection groove recessed into the fixed thrust surface or the orbiting thrust surface by a predetermined depth; and an oil supply extension groove having a first end that communicates with the oil supply connection groove and a second end that communicates with the compression chamber, wherein the second end of the oil supply extension groove is spaced apart from the oil supply connection groove, wherein the oil supply extension groove overlaps the orbiting thrust surface or the fixed thrust surface in an axial direction between ends thereof, and wherein a cross-sectional area at an end portion of the oil supply extension groove toward the oil supply connection groove is smaller than a cross-sectional area at an end portion toward the compression chamber.

* * * * *